US011440168B2

(12) United States Patent
Brown

(10) Patent No.: US 11,440,168 B2
(45) Date of Patent: Sep. 13, 2022

(54) BACKUP WRENCHES

(71) Applicant: Integrity Engineering Solutions Pty Ltd, Dunsborough (AU)

(72) Inventor: Ian Warren Brown, Dunsborough (AU)

(73) Assignee: Integrity Engineering Solutions Pty Ltd, Dunsborough ( * ) Notice: Subject to any disclaimer, the term of this patent is extended or adjusted under 35 U.S.C. 154(b) by 256 days.

(21) Appl. No.: 16/740,094

(22) Filed: Jan. 10, 2020

(65) Prior Publication Data

US 2020/0206883 A1 Jul. 2, 2020

Related U.S. Application Data

(63) Continuation of application No. PCT/AU2018/050715, filed on Jul. 11, 2018.

(30) Foreign Application Priority Data

Jul. 11, 2017 (AU) ..... 2017902718

(51) Int. Cl.
*B25B 23/00* (2006.01)
*B25B 13/52* (2006.01)
*B25B 23/142* (2006.01)

(52) U.S. Cl.
CPC ..... *B25B 23/0085* (2013.01); *B25B 13/52* (2013.01); *B25B 23/1427* (2013.01)

(58) Field of Classification Search
CPC ..... B25B 23/0078; B25B 23/0085; B25B 23/0092; B25B 13/52; B25B 23/1427;
(Continued)

(56) References Cited

U.S. PATENT DOCUMENTS 3,342,090 A * 9/1967 Martin ..... B25B 23/0085 81/426
3,535,959 A * 10/1970 Riza ..... B25B 23/1427 81/472

(Continued)

FOREIGN PATENT DOCUMENTS

CN 2239867 11/1996
CN 102554869 A 7/2012

(Continued)

*Primary Examiner* — Robert J Scruggs
(74) *Attorney, Agent, or Firm* — Levine Bagade Han LLP

(57) ABSTRACT

A reaction torque limiting backup wrench arrangement (1) has at least one fastener engaging means e.g. spanner (6) or socket (170), for a pressure boundary bolted joint nut (5) of a respective fastener (3). The backup wrench arrangement provides a reaction torque up to a threshold above which rotation allowed by motion of the fastener engaging means is determined by a magnitude of the reaction torque and force deflection characteristic of a biasing arrangement acting directly or indirectly on the fastener engaging means. Tension in the flexible tension element e.g. chain (7) urges the spanner (6) onto the nut (5) of the fastener permitting the spanner to displace when torque transmitted through a bolt to the nut or bolt head within the spanner exceeds a threshold torque, enabling the nut or bolt head to rotate, helping prevent bolt over-tightening, and helping indicate the bolt seizing or galling.

28 Claims, 15 Drawing Sheets

(58) Field of Classification Search
CPC ..... B25B 23/00; B25B 23/08; B25B 13/48; B25B 23/10; B25B 9/00; B25B 23/02; B25B 23/04; B25B 23/142; B25B 13/50
See application file for complete search history.

(56) References Cited

U.S. PATENT DOCUMENTS

| | | | | |
|---|---|---|---|---|
| 5,337,638 | A | 8/1994 | Coss et al. | |
| 6,374,706 | B1 * | 4/2002 | Newman | E21B 19/166 81/57.16 |
| 6,427,558 | B1 * | 8/2002 | DeLand | B25B 23/0078 81/13 |
| 6,955,105 | B2 * | 10/2005 | Chen | B25B 13/04 81/125 |
| 7,895,920 | B2 * | 3/2011 | Abunameh | B25B 13/481 81/58.2 |
| 8,925,424 | B1 * | 1/2015 | Jacobs | B25B 13/48 81/13 |
| 2013/0180364 | A1 | 7/2013 | Galat | |

FOREIGN PATENT DOCUMENTS

| | | |
|---|---|---|
| DE | 102008023657 | 11/2009 |
| WO | WO 2007/144691 | 12/2007 |
| WO | WO 2019/010531 | 1/2019 |

* cited by examiner

BACKUP WRENCHES

CROSS-REFERENCE TO RELATED APPLICATIONS

This application is a continuation of International Application Number PCT/AU2018/050715 filed Jul. 11, 2018, which claims priority to Australian Application No. 2017902718, filed Jul. 11, 2017, both of which are incorporated herein by reference in their entireties.

FIELD OF INVENTION

The present invention relates to the field of backup wrenches.

A non-limiting application of the present invention provides a backup wrench arrangement for limiting the rotation of one or multiple fastener elements, for example to facilitate the checking, tightening and/or loosening of arrangements of nuts and bolts on bolted joints such as those found on pressure boundary bolted joints.

BACKGROUND TO THE INVENTION

When tightening, loosening and/or checking the tightening torque on a bolted joint, it is known to use a backup wrench as disclosed for example in U.S. Pat. No. 1,431,832. The backup wrench is placed on a nut or a bolt head on a first side of the bolted joint and the lever portion of the backup wrench rests against the head of another bolt to prevent rotation of the wrench and therefore the nut or bolt head on which it is placed. An operator can then apply a tightening torque to the opposite end of the bolt on the second side of the bolted joint, the tightening torque being partially reacted by the backup wrench without needing an additional operator on the first side of the bolted joint. There are however a number of issues with such labour saving devices such as rotation in one direction only is resisted, unless the backup wrench rotates until the lever portion contacts the head of another adjacent bolt.

U.S. Pat. No. 5,954,466 shows a similar tool for use on flanged bolted joints, in which the tool clips around a feature adjacent to the nut or bolt head on which the backup wrench is positioned, so if the tool is suited to a specific arrangement of nut or bolt head size and relative flange outer surface, the backup wrench can resist rotation in both possible directions, i.e. loosening or tightening, without adjustment. However another disadvantage of such backup wrenches is that once a large torque has been applied to the fastener and has generated a reaction torque at the backup wrench, the lever portion of the backup wrench becomes jammed onto the torque reacting adjacent bolt or flange edge making it difficult or impossible and unsafe for the operator to overcome the frictional force of the lever portion and remove the backup wrench from the nut or bolt head. A threaded push bolt is optionally provided in the backup wrench of U.S. Pat. No. 5,954,466 to enable the backup wrench to be drawn off the nut or bolt head in these situations.

United Kingdom patent number GB2478955 discloses a backup wrench having a hexagonal socket including a threaded locking screw which can be tightened against one corner of a nut or bolt head over which the backup wrench is placed. This provides two advantages, firstly to enable any residual reaction torque in the backup wrench due to tightening of the bolt to be released after use by releasing the locking screw and secondly to lock the backup wrench onto the nut or bolt head to prevent it from falling off. Both of these advantages improve practicality and safety in use.

However another disadvantage of the above mentioned backup wrenches is their fixed hexagonal or polygonal socket size.

International patent application publication number WO2011/100256 discloses a backup wrench having an irregular hexagonal socket incorporating a threaded locking screw that in addition to locking the wrench to the nut or bolt and allowing it to be released after the fastener is torqued up, also allows for a range of sizes of hexagonal nuts or bolt heads to be operatively engaged and even ranges of other polygonal shaped nuts or bolt heads to be engaged through the use of alternate socket forms all incorporating the locking screw.

All of the above backup wrenches are for use on a single fastener, yet are typically used for the installation and maintenance of pressure boundary bolted joints incorporating multiple bolts, so either many such tools need to be installed on one side of the joint to enable the nuts or bolt heads on the opposite side of the joint to be adjusted in quick succession, or the one tool must be moved from bolt to bolt making the process extremely laborious and inefficient.

U.S. Pat. No. 5,429,465 discloses a plate incorporating multiple hexagonal sockets in a fixed spatial relationship to enable all the bolts of a single pressure boundary bolted joint to be adjusted in quick succession. However this tool is limited to use with a specific nut or fastener size, number and circumferential spacing.

Chinese patent number 102554869 discloses an open ended hexagonal socket backup wrench unit part, multiple such unit parts being attached together in a manner similar to links in a chain to enable all of the nuts or bolt heads in a circumferential arrangement to be engaged, where the number of unit parts or links is changed to suit the number of nuts or bolt heads on the joint. However while varying the number of unit parts or links allows a variable number of nuts or bolt heads to be engaged in circular arrangements in a range of diameters, the spacing between each nut or bolt head is fixed by the dimensions of the backup wrench unit parts.

It would therefore be desirable to provide a backup wrench spanner and/or a backup wrench arrangement that overcomes one or more of the disadvantages of the aforementioned arrangements.

SUMMARY OF THE INVENTION

Throughout this specification, the term backup wrench or backup wrench arrangement is used when referring to a tool used to provide grip and provide a reaction torque on a rotary fastener such as a bolt or nut. The term spanner or socket is used when referring to a fastener engaging means being the portion of the backup wrench or backup wrench arrangement that engages with the rotary fastener. For example, a spanner typically engages with at least two faces of a hexagonal nut or bolt head, whereas a socket typically engages with the six faces of a hexagonal nut or bolt head.

According to a first aspect of the invention there is provided a backup wrench arrangement including at least a first fastener engaging means including at least a first engagement surface and a second engagement surface for respectively engaging in use with at least two faces of a first nut or bolt head of a first fastener; wherein the first fastener engaging means allows rotation of the first nut or bolt head above a threshold of a reaction torque, by motion of the first fastener engaging means determined by a magnitude of the reaction torque and a force-deflection characteristic of a biasing arrangement acting directly or indirectly on the first fastener engaging means.

Another aspect of the present invention provides a backup wrench arrangement including at least a first fastener engaging means including at least a first engagement surface and a second engagement surface for respectively engaging in use with a respective face of a first nut or bolt head of a first fastener; wherein the first fastener engaging means allows rotation of the first nut or bolt head of the first fastener relative to the backup wrench arrangement when the first nut or bolt head is subjected to a reaction torque above a threshold reaction torque; the rotation of the first nut or bolt head being allowed by motion of the first fastener engaging means determined by a magnitude of the reaction torque and a force-deflection characteristic of a biasing arrangement acting directly or indirectly on the first fastener engaging means.

Force-deflection characteristic encompasses one or more of stiffness, load deflection, flex, resilience and may include an offset due to preload of the biasing arrangement.

The allowed rotation may be a continuous rotation while or whenever the reaction torque is greater than the threshold reaction torque. The continuous rotation may provide a continuous rotation torque release function where, if continued tightening torque is applied to the fastener, the nut can rotate. A load in the biasing arrangement may be selectively reducible or releasable to enable the backup wrench arrangement to be removed. For example, after the at least a first fastener has been tightened, the backup wrench may become jammed until at least a portion of the reaction torque or any residual reaction torque is released.

The threshold reaction torque may be between 5 and 50 percent or preferably between 10 and 30 percent of a target tightening torque to be applied to the first fastener. For example, the threshold reaction torque may be adjustable to a set point that is between 5 and 50 percent or preferably between 10 and 30 percent of the desired tightening torque.

The motion of the first fastener engaging means may be substantially radial (such as with respect to the fastener or nut or bolt head or relative to an array of fasteners e.g. a ring arrangement of fasteners), the biasing arrangement providing a biasing force to bias the first and second engagement surfaces of the first fastener engaging means onto the respective faces of the first nut or bolt head of the first fastener.

The biasing arrangement may include a flexible tension element, the biasing arrangement acting directly or indirectly on at least a second nut or bolt head to bias the first and second engagement surfaces of the first fastener engaging means towards the respective faces of the first nut or bolt head. For example, the biasing arrangement may act on the second nut or bolt head and on a third nut or bolt head. The second and third nuts or bolt heads may be either side of the first nut or bolt head towards which the first fastener engaging means is biased. Alternatively or additionally, the backup wrench arrangement may further include at least a second fastener engaging means, the at least a second fastener engaging means including a guide for partially locating the flexible tension element, each respective fastener engaging means being engaged with a respective nut or bolt head in use. The backup wrench arrangement may further include a tensioning arrangement for applying a tension to the flexible tension element in use. For example, the tensioning arrangement can be separate from the first fastener engaging means or incorporated into the first fastener engaging means.

The backup wrench arrangement may include a lever portion having a first loop portion at a first end, the first loop portion being arranged to pass around a portion of the first nut or bolt head in use; the first fastener engaging means being slidably located relative to the lever portion; the biasing arrangement acting between the lever portion and the first fastener engaging means; in use, the lever portion contacting a second nut to prevent rotation of the lever portion. The biasing arrangement may act directly or indirectly between the lever portion and the first fastener engaging means.

The biasing arrangement may include a resilient device, a load on the resilient device being adjustable to adjust the biasing force and thereby vary the reaction torque on the first nut or bolt head at which the first fastener engaging means deflects the resilient device and permits rotation of the first nut or bolt head. The resilient device may be or include, for example, a spring, such as a coil spring or torsion spring. The load on the resilient device may be adjustable using a bias force adjuster such as a preload screw.

The backup wrench arrangement may include a lever portion and may further include a second fastener engaging means, the lever portion having a second loop portion at a second end arranged to pass around a portion of a second nut in use; the second fastener engaging means being slidably located relative to the lever portion; the biasing arrangement acting between the lever portion and the second fastener engaging means. In use, the lever portion may contact another nut to prevent rotation of the lever portion. The biasing arrangement may act directly or indirectly between the lever portion and the second fastener engaging means. The biasing arrangement may have a single biasing arrangement acting on both the first and second fastener engaging means, or preferably the biasing arrangement may comprise separate first and second biasing arrangements.

At least one of the first and second engagement surface may include at least one ridge or groove. Preferably the at least one ridge or groove may be oriented in a direction substantially parallel with a primary axis of the first nut.

The backup wrench arrangement may further include a quick-release arrangement (such as a mechanism or device) for reducing and restoring the biasing force. Typically the quick release arrangement may be a lever mechanism providing an over-centre action to maintain the restored biasing force or restored biasing arrangement adjustment until the lever mechanism is operated to reduce or release the biasing force or adjustment.

The backup wrench arrangement may further include a lever portion, the motion of the first fastener engaging means being substantially a rotation relative to the lever portion, such relative rotation being inhibited by and/or requiring deflection of the biasing arrangement. For example, the first fastener engaging means may move primarily in a rotation about a primary axis of the first fastener. The biasing arrangement may include at least one resilient member. The first fastener engaging means may include or may be provided by a socket portion.

The lever portion may include a substantially circular hole into which the socket portion protrudes or is housed. The backup wrench may further include a detent mechanism including the resilient member, the detent mechanism acting between the lever portion and the socket portion to prevent said relative motion until the threshold reaction torque on the first nut is exceeded. Alternatively, the backup wrench may further include a ratchet mechanism including a pawl pivotally mounted to the lever portion, teeth on the socket portion and including the resilient member acting between the pawl and the lever portion, such that when in use the threshold reaction torque on the first nut is exceeded, one of the teeth on the socket provides a force generating a moment on the pawl that exceeds a moment applied to the pawl by the resilient member. The pawl may rotate and permit a limited rotation of the socket portion relative to the lever portion.

Alternatively, the lever portion may be attached to the socket portion by a pivot, the resilient member being connected directly or indirectly between the socket portion and the lever portion such that the relative rotation between the socket portion and the lever portion generates a deflection of the resilient member, the lever portion and resilient member being arranged such that when a reaction torque on the first nut generates a limit moment on the lever portion reacted by the second nut, the limit moment deflects the resilient member to permit sufficient relative rotation of the lever portion and the socket portion such that the lever portion passes between the first nut and the second nut.

The first nut or bolt head may be a first nut and the first fastener may further include a second nut or bolt head, a tightening torque being applied to the first fastener at the second nut or bolt head during use.

The first nut or bolt head may be a first bolt head, the fastener including a second nut, a tightening torque being applied to the first fastener at the second nut during use.

Another aspect of the present invention provides a spanner for a backup wrench arrangement, the spanner comprising: at least a first and a second engagement surface for engaging in use with two faces of a nut or bolt head or any other polygonal nut-like member, and a channel to receive a portion of a flexible tension element.

The spanner may further include a retaining arrangement to enable the spanner, in use, to be retained in proximity to a nut or bolt head with which the spanner is engaged. The retaining arrangement may be or include at least one magnet or magnetic portion. For example, at least one of the engagement surfaces may include a (or a respective) magnet forming the at least one magnetic portion to enable the spanner to be magnetically attracted or attached in use to a nut or bolt head that is formed from a material that is attracted to magnets. Additionally or alternatively, a magnet may be located elsewhere in the spanner such as in a face of the spanner that is substantially perpendicular to the first and second engagement surfaces to attract the spanner to a ferromagnetic material that is being clamped by a bolt to which the nut or bolt head is attached in use, such as for example a flange of a pressure joint.

Alternatively or additionally, the retaining arrangement may include a tie attachable to a first side of the spanner and attachable to a second side of the spanner such that an active length of the tie is adjustable to enable nuts or bolt heads of differing sizes to be retained. Alternatively, or additionally the retaining arrangement may include at least one spring clip and/or a resilient boot or socket. Alternatively, or additionally the retaining arrangement may include an adjustable or otherwise moveable jaw (including a spring-loaded jaw) to enable nuts or bolt heads of differing sizes to be accommodated.

The first and second engagement surfaces may be inner surfaces, having for example a 60 degree included angle, for engaging a first and a third face respectively of a hexagonal nut or bolt head. The spanner may further include a tensioning surface forming a base of the channel, the tensioning surface having for example an external angle of substantially 60 degrees to a plane extended from the first engagement surface and an external angle of substantially 60 degrees to a plane extended from the second engagement surface.

Alternatively, the first and second engagement surfaces may be inner surfaces, having for example a 120 degree included angle, for engaging a first and a second face respectively of a hexagonal nut or bolt head. The spanner may further include a tensioning surface forming a base of the channel, the tensioning surface having for example an external angle of substantially 30 degrees to a plane extended from the first engagement surface and an external angle of substantially 30 degrees to a plane extended from the second engagement surface.

The first and second engagement surfaces of the spanner may be symmetrical about a spanner centre plane. In that case, the channel may either have a flat base portion that is perpendicular to the spanner centre plane, or alternatively, have a curved base portion wherein a tangent to the curved base portion at a point where the spanner centre plane intersects the curved base portion is perpendicular to the spanner centre plane.

The spanner may be a terminating spanner further including a tensioning arrangement for applying a tension to the flexible tension element in use. The tensioning arrangement may include a ratchet pawl, a lever and/or a screw.

The spanner may further include a leash point. This can be any feature that enables a leash to be attached for safety, such as for example a hole, a loop or a hook.

Another aspect of the present invention provides a backup wrench arrangement comprising at least one spanner and a said flexible tension element. The spanner may comprise at least a first and a second engagement surface for engaging in use with two faces of a nut or bolt head or any other polygonal nut-like member, and a channel to receive a portion of the flexible tension element.

One of the at least one spanner may be a terminating spanner, the terminating spanner further including a tensioning arrangement for applying a tension to the flexible tension element in use. The magnitude of tension applied to the flexible tension element may be controlled to limit a reaction torque able to be reacted by the at least one spanner. The channel in the terminating spanner may guide the flexible tension element either to a termination point or to the tensioning arrangement. The at least one spanner may include the terminating spanner and may further include at least one intermediate spanner. The channel in the intermediate spanner or each intermediate spanner may guide the local alignment of flexible tension element relative to the respective intermediate spanner.

Alternatively, the spanner or one of the spanners may include a spanner centre plane, the first and second engagement surfaces of said spanner being symmetrical about the spanner centre plane. Said spanner further including a base portion of the channel of said spanner, the base portion being substantially perpendicular to the spanner centre plane in the region where the spanner centre plane intersects the base portion.

The backup wrench arrangement may include a tensioning arrangement for applying a tension to the flexible tension element in use. For example, the or all of the spanners may be similar (i.e. none includes a tensioning element) and the tensioning element may be provided separately, or as part of the flexible tension element. For example, the flexible tension element may include a ratchet strap, such as a webbing strap including at one end a ratchet-type tensioning arrangement into which the other end of the webbing strap is passed, then tightened, in use.

The backup wrench arrangement may be adjustable to the number of fasteners on a joint, such that the at least one spanner is a number of spanners equal to the number of fasteners. Alternatively, the at least one spanner may be multiple spanners, such that the flexible tension element can be in the channel of each of the multiple spanners, each of said spanners being engaged with a fastener on a joint, the spacing between the spanners being variable to accommodate for example different pitch circle diameter and/or pitch spacing of the fasteners. The one tool thereby accommodating a range of fastener arrangements for example, whilst being straightforward to position and operate, providing significant time savings in set up in addition to the time saved by the use of a multiple backup wrench tool for checking, tightening or releasing the fasteners in a joint.

Another aspect of the present invention provides a fastener backup method comprising the steps of: placing at least one spanner of a backup wrench arrangement on a respective nut or bolt head of an arrangement of fasteners; disposing a flexible tension element in a respective channel of the or each said spanner around the arrangement of fasteners; and applying a tension to the flexible tension element.

The spanner may comprise at least a first and a second engagement surface for engaging in use with two faces of a nut or bolt head or any other polygonal nut-like member, and a channel to receive a portion of the flexible tension element.

The step of placing at least one spanner of a backup wrench on a respective nut or bolt head of an arrangement of fasteners may include the step of attaching the or each spanner to the respective nut or bolt head, for example to retain the spanner in proximity to the respective nut or bolt head. The step of attaching the or each spanner to the respective nut or bolt head may include engaging at least one respective magnetic portion of the spanner with the nut, bolt head or an adjacent surface. Alternatively or additionally, the step of attaching the or each spanner to the respective nut or bolt head may include engaging a respective tie from a respective spanner around the respective nut or bolt head and back to the spanner.

The step of applying a tension to the flexible tension element may include applying a known or measured tension to the flexible tension element. The known tension may be a predetermined maximum tension, limited using a known means. The measured tension may be measured continuously and monitored, or measured as an optional repeated step. The benefit of applying a known or measured tension to the flexible tension element can be, for example, to permit the, or one of the spanners to displace (for example radially with respect to a ring of fasteners) when a reaction torque transmitted through a bolt to the nut or bolt head within said spanner exceeds a predetermined torque to enable said nut or bolt head to rotate. This helps to limit the maximum torque applied to the bolts during tightening and can be used to ensure that bolts are not overtightened or indicate that a bolt is seized, thus improving the safety and stability of the bolted joint. It can also limit the maximum load in the flexible tension element. The spanner may displace at least radially with respect to a ring of fasteners when the predetermined torque, which may be a threshold reaction torque, is exceeded. The reaction torque may be a portion of the torque transmitted through a bolt to the nut or nut head, the remainder being for example friction between the nut or bolt head and its engaging surface, being the surface it is pulled up against.

The arrangement of fasteners may be a ring of bolts clamping a pressure boundary bolted joint or a flanged connection such as for example a pressure pipe joint.

Another aspect of the present invention provides a backup wrench arrangement including: a spanner for a backup wrench arrangement, the spanner including at least a first and a second engagement surface for respectively engaging in use with at least two faces of a first nut or bolt head or any other polygonal nut-like member having at least four faces; and a biasing arrangement acting, in use, to provide a biasing force on the spanner to urge or bias the first and second engagement surfaces of the spanner towards a respective face of the first nut, the biasing arrangement deflecting to permit at least radial motion of the spanner relative to the first nut when a reaction torque on the first nut generates a force on the spanner that is greater than the biasing force.

Therefore, when the biasing force is overcome, the first nut can rotate, i.e. when the reaction torque is greater than a pre-set amount (or threshold) determined by the biasing arrangement.

The biasing arrangement may include a resilient member or a tensioning device or both.

The biasing arrangement may include a flexible tension element, the biasing arrangement acting directly or indirectly on at least a second nut or bolt head to bias the first and second engagement surfaces of the spanner towards the respective faces of the first nut. The biasing arrangement may act on the second nut or bolt head and on a third nut or bolt head (i.e. in addition to acting on the spanner). Alternatively, the spanner may be a first spanner and the backup wrench arrangement may further include at least a second spanner, the at least a second spanner including a channel for partially locating the flexible tension element, each respective said spanner being engaged with a respective nut or bolt head in use. Alternatively or additionally, the backup wrench arrangement may further include a tensioning arrangement for applying a tension to the flexible tension element in use. The tensioning arrangement can be separate from the first spanner or incorporated into the first spanner.

Alternatively, the backup wrench arrangement may include a lever portion having a first loop portion at a first end, the first loop portion being arranged to pass around a portion of the first nut in use, the spanner being slidably located relative to the lever portion, the biasing arrangement acting (directly or indirectly) between the lever portion and the spanner, in use the lever portion contacting a second nut to prevent rotation of the lever portion. The biasing arrangement may include a resilient member (such as for example a coil spring), a load on the resilient member being adjustable (using for example a bias force adjuster such as a preload screw) to adjust the biasing force and thereby vary the reaction torque on the first nut at which the spanner deflects the resilient member and permits rotation of the first nut.

The spanner may be a first spanner and the backup wrench arrangement may further include a second spanner, the lever portion having a second loop portion at a second end arranged to pass around a portion of a second nut in use, the second spanner being slidably located relative to the lever portion, the biasing arrangement acting (directly or indirectly) between the lever portion and the second spanner.

At least one of the first and/or second engagement surfaces may include at least one ridge or groove (for example, a groove oriented in a direction substantially parallel with a primary axis of the first nut). Alternatively, at least one of the first and/or second engagement surfaces may include at least a knurled region or other form of increased surface roughness.

Another aspect of the present invention provides a backup wrench arrangement comprising a socket portion, a lever portion and a resilient member: the socket portion being attached to the lever portion such that relative rotation is permitted, such relative rotation being inhibited by and/or requiring deflection of the resilient member; in use, the socket portion engaging with a first nut or bolt head and the lever portion engaging with a second nut or bolt head.

The first nut or bolt head may be of a first fastener and the second nut or bolt head may be of a second fastener.

The backup wrench arrangement may resist or react a tightening torque up to a limit determined at least in part by the spring deflection.

The lever portion may include a substantially circular hole into which the socket portion protrudes or is housed, the backup wrench further including a detent mechanism including the resilient member, the detent mechanism acting between the lever portion and the socket portion to prevent said relative motion until a threshold reaction torque on the first nut is exceeded.

Alternatively, the lever portion may include a substantially circular hole into which the socket portion protrudes or is housed, the backup wrench further including a ratchet mechanism including a pawl pivotally mounted to the lever portion, teeth on the socket portion and including the resilient member acting between the pawl and the lever portion, such that when in use a threshold reaction torque on the first nut is exceeded, one of the teeth on the socket provides a force generating a moment on the pawl that exceeds a moment applied to the pawl by the resilient member. In this arrangement, when the moment of the pawl generated by the teeth exceeds the moment applied to the pawl by the resilient member, the pawl rotates and permits a limited rotation of the socket portion relative to the lever portion.

Alternatively, the lever portion may be attached to the socket portion by a pivot, the resilient member being connected directly or indirectly between the socket portion and the lever portion such that the relative rotation between the socket portion and the lever portion generates a deflection of the resilient member, the lever portion and resilient member being arranged such that when a reaction torque on the first nut generates a limit moment on the lever portion reacted by the second nut, the limit moment deflects the resilient member to permit sufficient relative rotation of the lever portion and the socket portion such that the lever portion passes between the first nut and the second nut.

It will be convenient to further describe the invention by reference to the accompanying drawings which illustrate preferred aspects of the invention. Other embodiments of the invention are possible and consequently particularity of the accompanying drawings is not to be understood as superseding the generality of the preceding description of the invention.

DESCRIPTION OF PREFERRED EMBODIMENT

Figure 1:
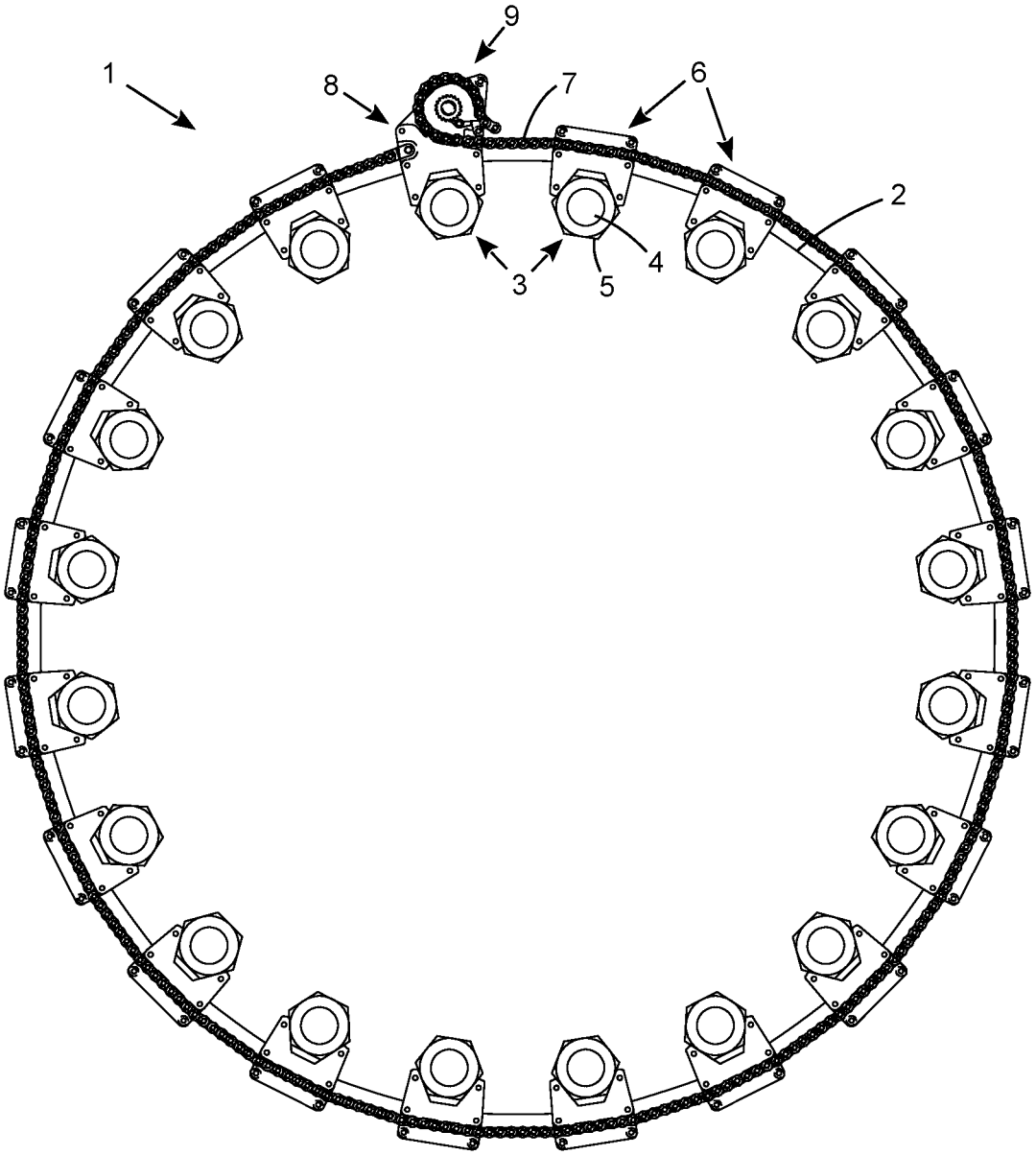
FIG. 1 is an end view of a backup wrench arrangement according to an embodiment of the present invention, in use.

Referring initially to FIG. 1, there is shown a backup wrench arrangement 1 in use on a flange 2 clamped by multiple fasteners 3. Such flanges are typically used on large pressure pipe joints. The fasteners 3 are typically stud bolts 4 with a nut 5 on either side of the flanged connection. The backup wrench arrangement 1 comprises multiple fastener engaging means, referred to herein as a spanner or spanners 6, in this example one (fastener engaging means) spanner for each fastener 3 of the joint. The spanners 6 are engaged with the fasteners 3 and forcibly urged onto the fasteners by the tension in the flexible tension element which in this example is a chain 7. The chain is terminated and tensioned by a tensioning arrangement 9 incorporated into a terminating spanner 8.

Figure 2:
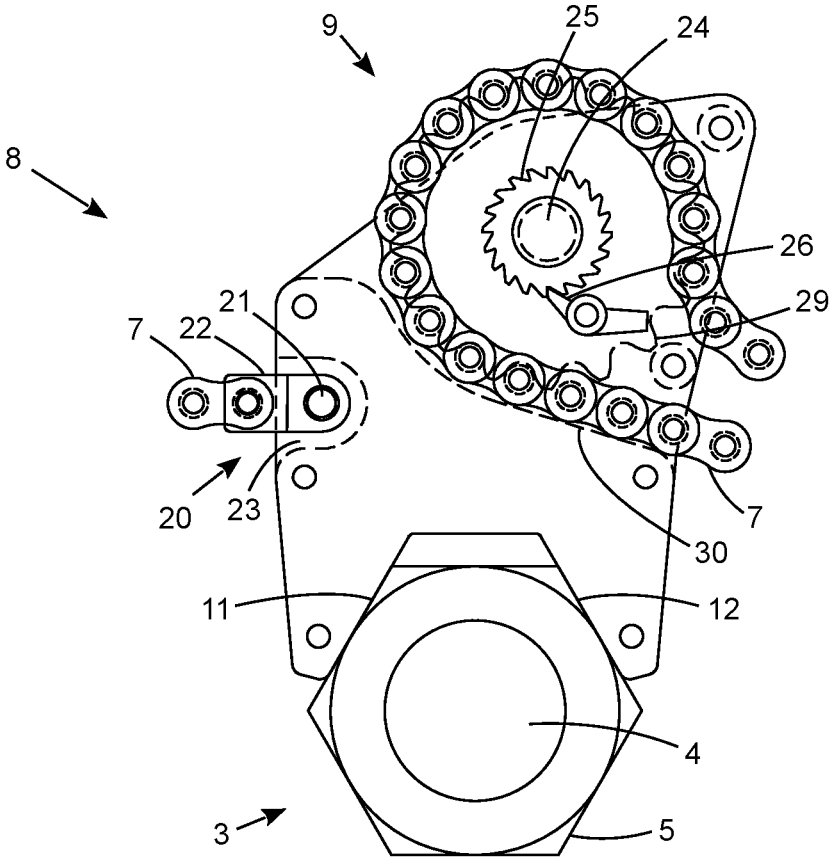
FIG. 2 shows a terminating spanner according to an embodiment of the present invention.

The terminating spanner 8 is shown in more detail in FIG. 2, engaged with a fastener from FIG. 1. Like all the other spanners in FIG. 1, it has two engaging surfaces 11, 12 for engaging two of the six drive surfaces of the hexagonal nut 5. The terminating spanner 8 also has a termination point 20 for the chain 7, including a pin 21 about which the end link 22 can pivot within recess 23. The tensioning arrangement 9 in this example is a ratchet type arrangement, with a shaft 24, locking gear 25 and pawl 26. The shaft 24 can be driven by any device such as a simple crank handle or for example a socket with a torque wrench to achieve a desired tension in the chain 7. The shaft 24 in turn drives a chain wheel or gear 29. In use, the free end of the chain 7 can be loaded into the channel 30 in the terminating spanner 8 then drawn through using the ratchet arrangement.

Using a torque wrench or measuring the tension in the chain 7 or other flexible tension element can be used to permit any of the spanners to displace (for example at least radially with respect to the ring of fasteners 8) when a torque transmitted through a bolt to the nut or bolt head within the spanner generates a reaction torque that exceeds a predetermined reaction torque (or threshold reaction torque) to enable said nut or bolt head to rotate. This can help prevent a bolt being over-tightened. It can also help indicate that a bolt is failing to tighten correctly due to being seized or galling. For example with a stud bolt, if the nuts on both the tightening side and on the spanner side are seized or galling, applying a torque puts the bolt into torsion but does not change the axial load on the bolt. So setting a known or predetermined tension in the chain 7 can allow the fastener to rotate relative to the spanner in either the over-tightening or the failure to tighten case, improving the quality assurance of the bolted joint through improving the safety and stability of the joint. Allowing the spanner to move relative to the fastener when a predetermined load is exceeded can also limit the load in the chain, further improving safety.

Typically, the reaction torque applied by the backup wrench or spanner to the nut with which it is engaged, is within 5 to 50 percent of the tightening torque applied on the tightening side of the fastener. More usually, the reaction torque is within 10 to 30 percent of the tightening torque. Much of the remaining 70 to 90 percent of the tightening torque is reacted by friction between the nut and the engaging surface that the nut is pulled up against. The exact reaction torque required is dependent on many factors, so being able to set the tension in the chain 7 effectively provides an adjustable set point, the chain tension being set to permit nut rotation at the desired reaction torque, which could for example be at 22 percent of the desired tightening torque. In that example, below 22 percent of the desired tightening torque, the spanner provides a reaction torque which reacts the torque from the nut with which it is engaged. But above that pre-set or threshold reaction torque of 22 percent of the desired tightening torque, the chain 7 of the backup wrench arrangement allows the spanner 8 to deflect sufficiently for the nut 5 to rotate relative to the spanner, indicating a problem. The problem can be that the nut 5 is seized onto the bolt 4 of the fastener 3 as mentioned above, or it can be another problem such that the desired tightening torque has been exceeded or that tightening of the fastener has proceeded after the desired bolt tension has been reached. The backup wrench arrangement can therefore also help prevent overtightening of fasteners.

Figure 3:
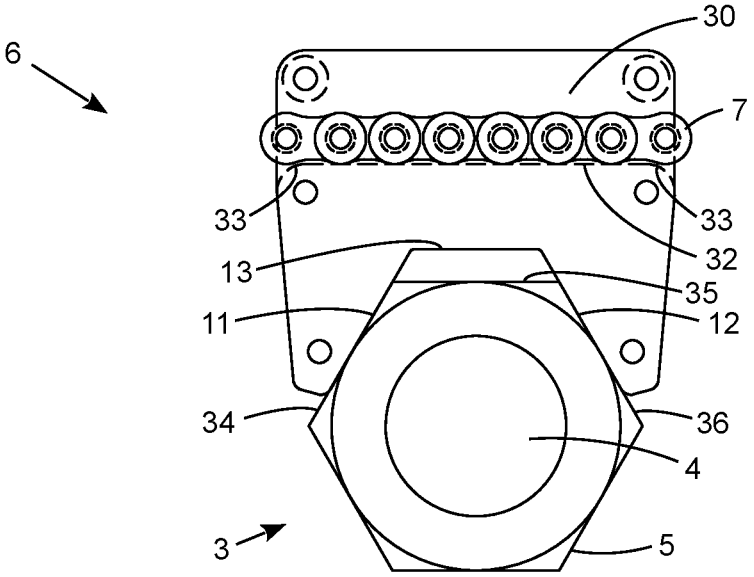
FIG. 3 shows a spanner according to an embodiment of the present invention, on a fastener from FIG. 1.

The other spanners 6 consist primarily of the two engaging surfaces 11, 12 and the channel 30 in which the chain 7 sits, in use, as shown in FIG. 3. As the chain is tensioned, the radial load exerted inwardly towards the centre of the circumferential arrangement of fasteners 3 shown for example in FIG. 1, causes the chain to exert that force through the base surface 32 of the channel 30 in each spanner 6. As the rotation of the nut 5 in FIG. 3 for example is resisted by the two engagement surfaces 11 and 12, so the rotation of the spanner 6 is resisted by a force that peaks towards one end of the base surface 32 of the channel 30. The end at which this reaction force is highest is dependent on the direction of rotation of or torque on the fastener 3. The base of the channel is preferably flat or slightly curved in a concave sense or any other shape in which the shoulders 33 at the ends of the channel 30 are at a greater distance than the centre or the rest of the channel 30 from the centre of the ring of fasteners to which the backup wrench arrangement is intended to be used. The shoulders 33 at either end of the base surface 32 of the channel 30 are rounded in this example to improve durability and limit the point loading where the reaction force peaks. The top of the channel 30, i.e. opposite the base 32, is shown as open in this example, so the chain 7 can be laid into the channel 30 when assembling the backup wrench arrangement 1 onto a ring of fasteners 3 as shown in FIG. 1.

The two engaging surfaces 11, 12 of the spanner 6 in FIG. 3 have an included angle of 60 degrees to engage the first 34 and third 36 faces of a hexagonal nut 5. The other internal surface 13 of the spanner 6 between the engaging surfaces 11, 12 is clear of the second face 35 of the nut 5 in the example shown in FIG. 3, by quite a large gap. This is primarily because the spanner is designed to accommodate a range of different sizes of hexagonal nut or bolt head.

Figure 4:
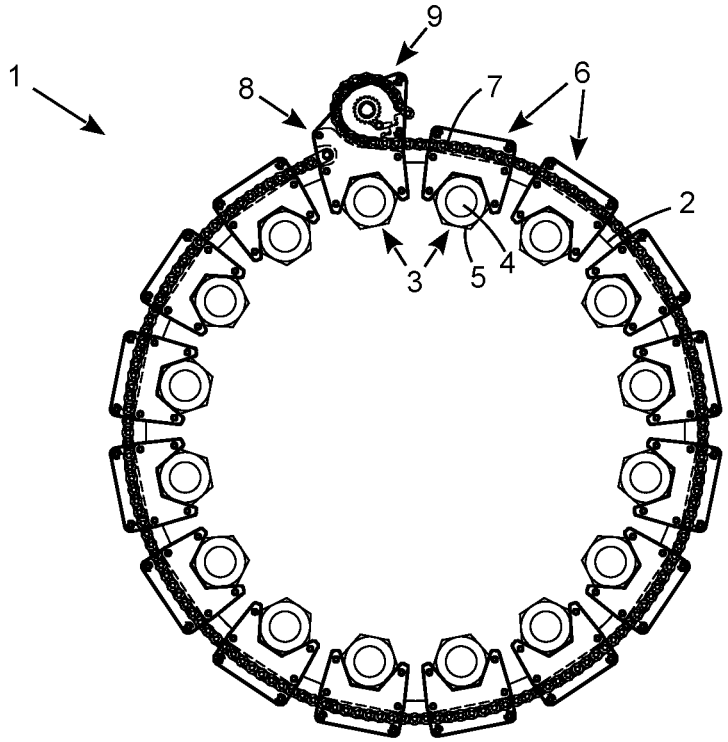
FIG. 4 shows the backup wrench arrangement of FIG. 1 on a smaller flange with smaller fasteners.
Figure 5:
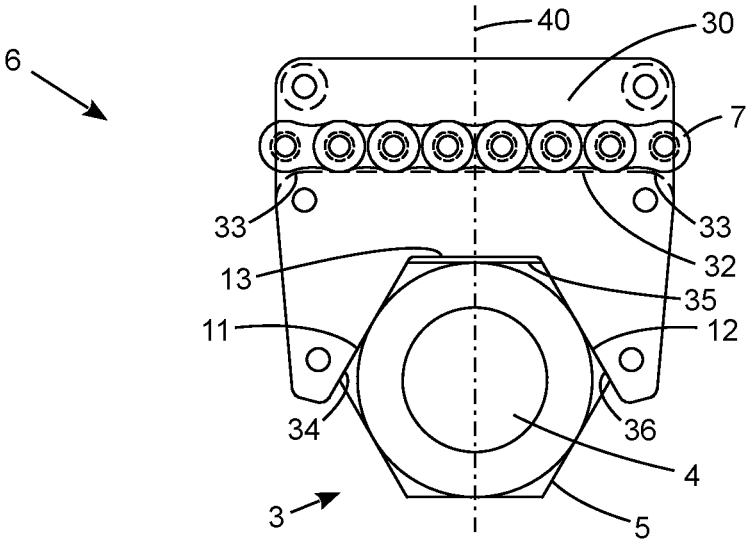
FIG. 5 shows the spanner from FIG. 3 on one of the smaller fasteners of FIG. 4.

FIG. 4 shows the same backup wrench spanners from FIGS. 1 to 3 applied to a smaller diameter flanged pressure joint. This joint has only sixteen fasteners compared to the twenty fasteners of FIG. 1 so only 15 spanner units 6 are required along with the terminating spanner unit 8. Also the fasteners 3 in FIG. 4 are smaller compared to fasteners in FIGS. 1 to 3. As the spanners are the same as in FIGS. 1 to 3 the gap between the internal surface 13 of the spanners and the second face 35 of the nuts 5 is much smaller, as shown in FIG. 5, when the spanners are used on such smaller nuts. The spanner 6 in the examples in FIGS. 3 and 5 is symmetrical about a plane through the centre-line 40, so the internal surface 13 and the base 32 of the channel 30 are both perpendicular to this plane. Similarly, a plane extended from either of the engagements surfaces 11 or 12 forms an external angle of 60 degrees to the internal surface and to the base 32 of the channel.

Figure 7:
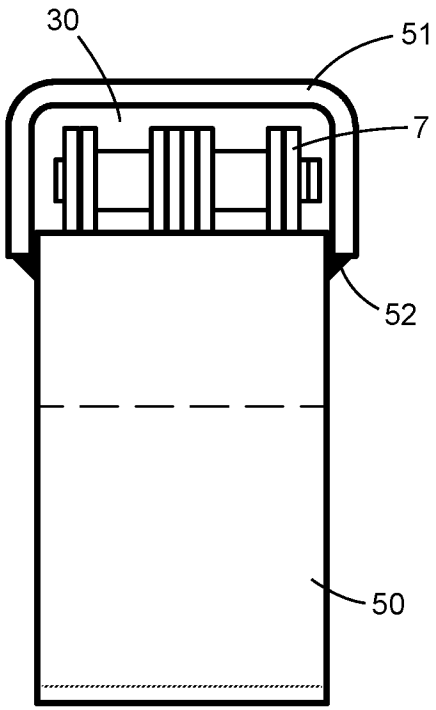
FIG. 6 shows a spanner having a closed channel according to an embodiment of the present invention and FIG. 7 is a projection from FIG. 6.
Figure 6:
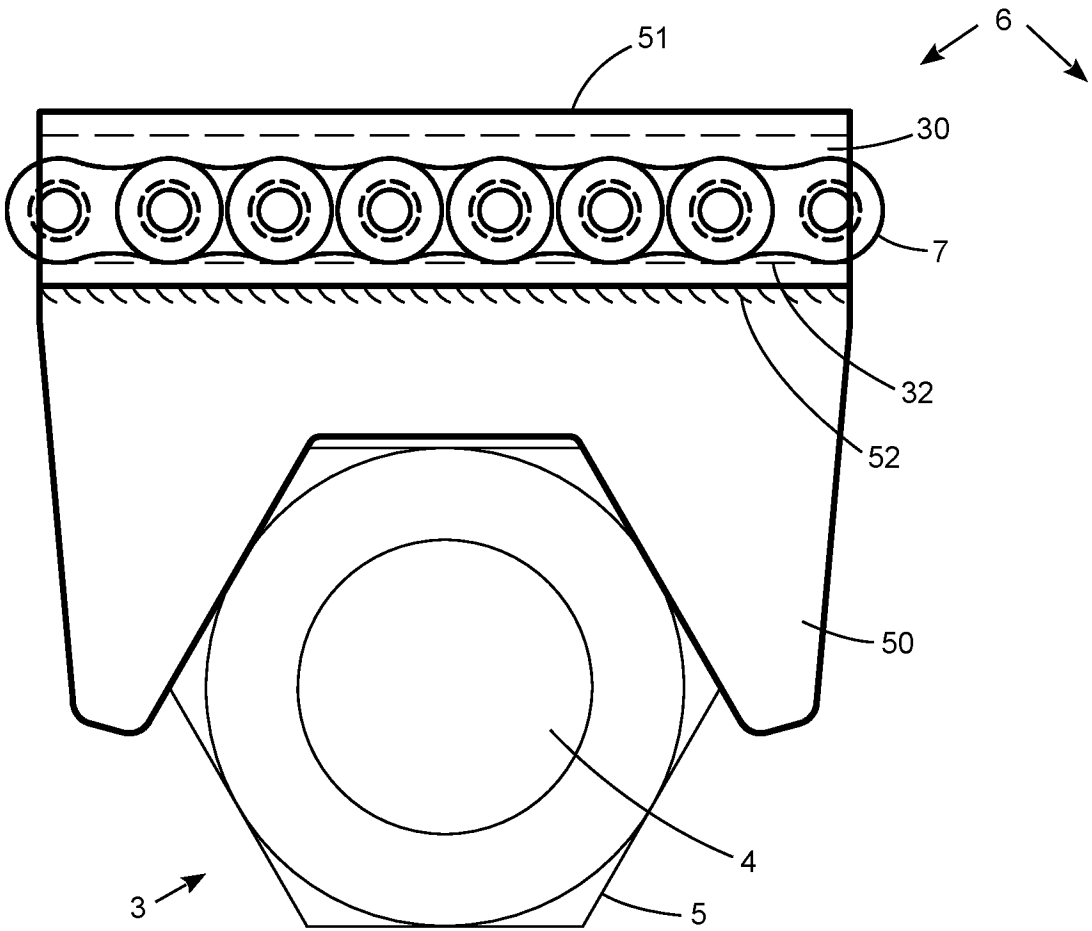

FIGS. 6 and 7 show an alternative embodiment of the spanner 6, having a closed channel 30 through which the chain 7 can be passed. In this specific example, the channel 30 is formed by welding a C-section 51 onto a block or main body 52 of the spanner 6 at welds 52. In FIG. 6 the spanner 6 is shown on a smaller nut 5 similar to those in FIGS. 4 and 5. FIG. 7 is a projection of FIG. 6, but with the nut omitted. In some situations it can be advantageous to have the spanners 6 threaded onto the chain 7 ready for use, as permitted by a closed channel 30. In other situations it can be advantageous to allow the chain 7 to be threaded through the spanners 6 once the spanners are attached to the nuts of a joint.

Figure 8:
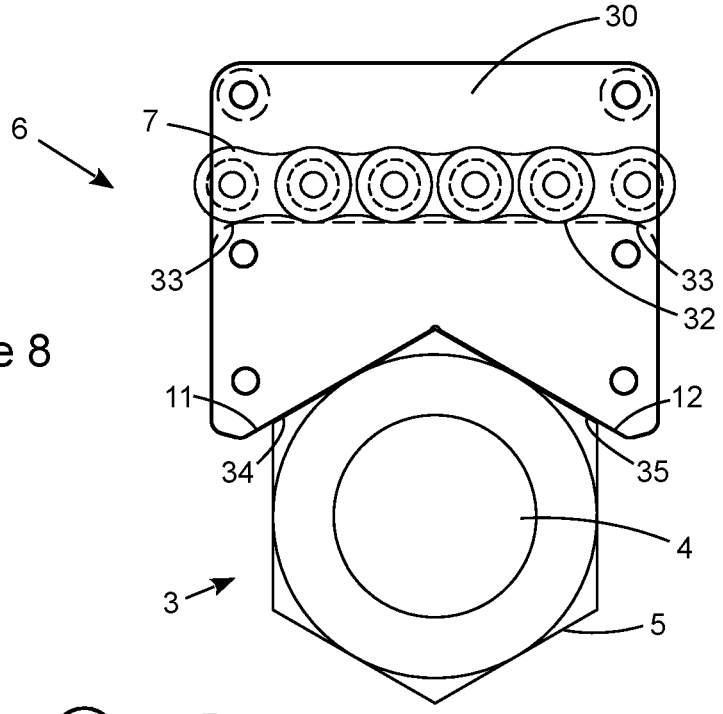
FIG. 8 shows a spanner having two adjacent engaging surfaces according to an embodiment of the present invention.

A further variation on the base spanner part 6 is shown in FIG. 8. While the upper section including the channel 30 is similar to that of the spanners 6 in FIGS. 1 to 5, the fastener engaging surfaces 11 and 12 now form an included angle of 120 degrees and so engage the first and second faces 35, 36 of the nut 5. While engaging adjacent faces of the fastener in this manner limits the rotation resisting reaction torque able to the applied by the backup wrench arrangement to a hexagonal nut 5 as shown, if the nut is square for example, the rotation resisting torque can be greater. The geometry of the fastener engaging surfaces 11, 12 is just one of the variables that can be used to set a maximum rotation resisting reaction torque in the backup wrench arrangement, along with for example, the geometry of the mating faces of the nut 5, the tension in the chain 7 and the geometry of the base surface 32 of the channel 30 where the chain 7 loads the spanner 6.

Figure 9:
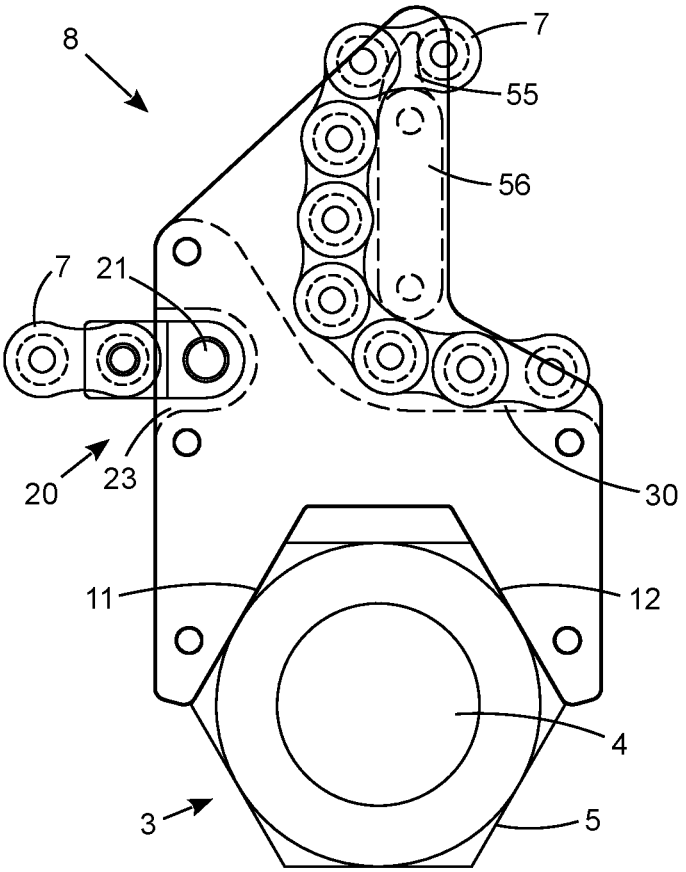
FIG. 9 shows an alternative terminating spanner according to an embodiment of the present invention.

FIG. 9 shows an alternative form of terminating spanner 8 in which the ratchet arrangement is replaced by a single tooth 55 at the end of a bar member 56 in the channel 30. The chain 7 is still terminated at the point 20 on the spanner 8. However in this example, the chain 7 is passed into the channel 30, around the bar member 56 and hooked onto the tooth 55. This arrangement has no moving parts, but as a result does not include a lever arrangement to allow amplification of an applied installation force into the tension force.

Figure 10:
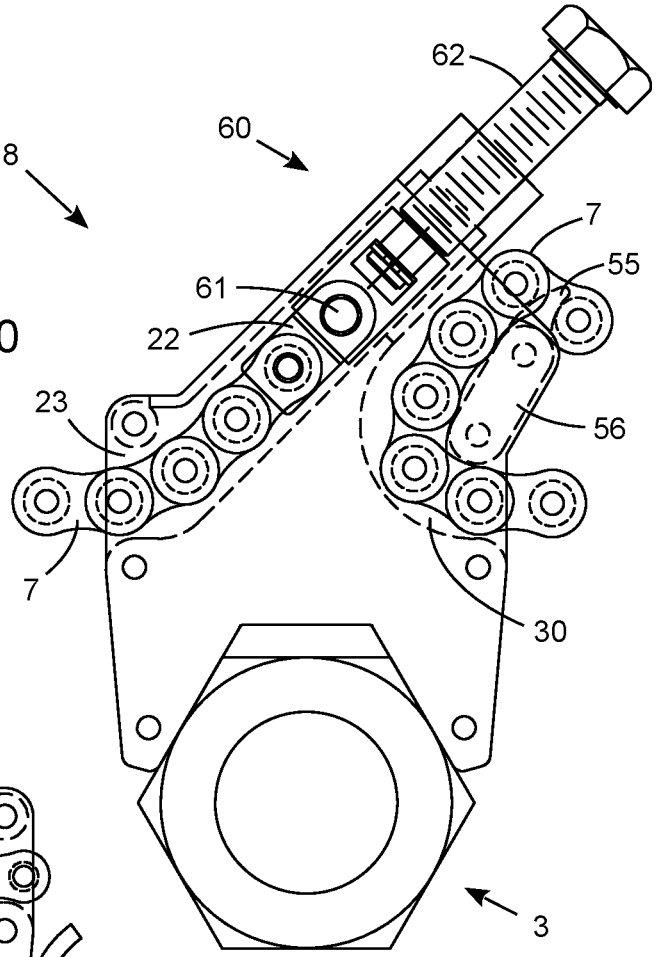
FIG. 10 shows a further alternative terminating spanner according to an embodiment of the present invention.

In the terminating spanner 8 in FIG. 10, the single tooth 55 and the bar member 56 of FIG. 9 are still present so that the chain 7 can be passed through the channel 30 and hooked onto the tooth 55. However the fixed pivot point or pin 21 of terminating point 20 in FIG. 9 has been replaced with an adjustable pivot point or pin 61 in the screw tensioning arrangement 60. The chain 7 now passes through an enlarged version of the recess 23 which has itself become a channel. The end link 22 of the chain is pivotally connected to the end of the adjustment screw 62. Ideally the adjustment screw 62 is wound in prior to installing the backup wrench arrangement onto an arrangement of fasteners. Once the chain 7 is passed through all the other spanners in the arrangement, it can be passed through the channel 30 around the bar member 56 and hooked onto tooth 55. Then the adjustment screw 62 can be wound out to increase the tension in the chain 7 to the desired magnitude.

Figure 11:
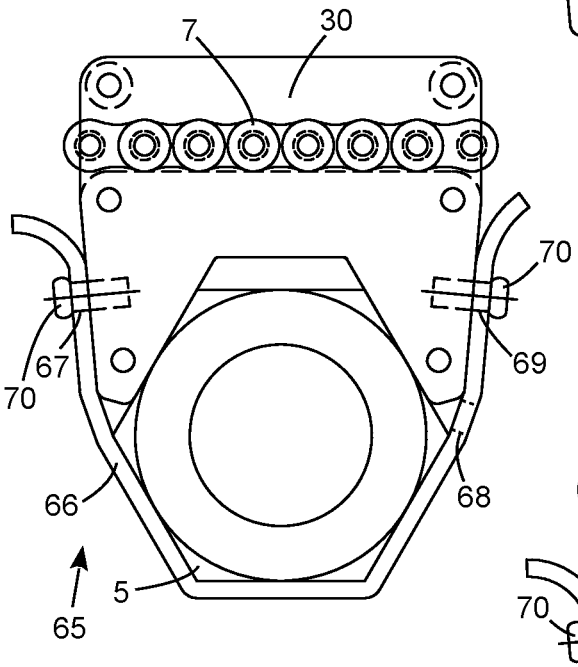
FIG. 11 shows a spanner including a retaining tie according to an embodiment of the present invention.
Figure 12:
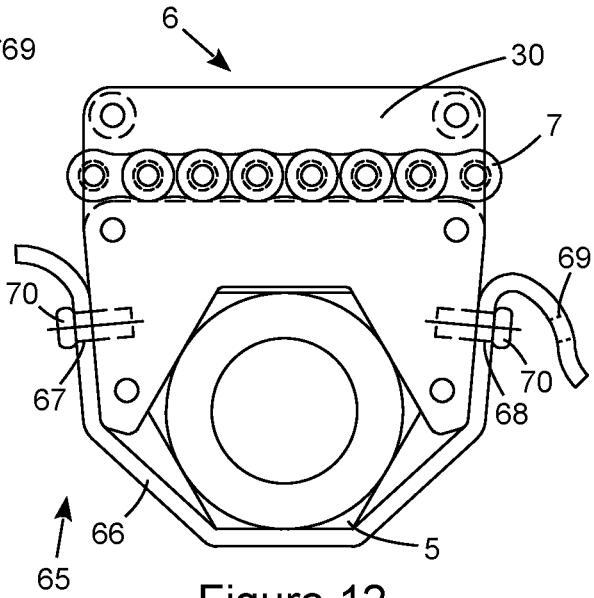
FIG. 12 shows the spanner from FIG. 11 on a smaller fastener.

FIG. 11 shows the spanner 6 of FIG. 3 with the addition of a retaining arrangement 65. A tie or strap 66 with holes 67, 68, 69 has for example a first of the holes 67 pushed over a first of the studs 70 fixed to the spanner 6, then the tie or strap is passed around the nut 5 and the hole 69 is pushed over the second of the studs 70. Two holes 68, 69 are shown towards one end of the strap on the to permit adjustment of the active length of the tie or strap for retaining nuts of differing sizes. Additional holes can also be provided and multiple holes can be provided towards the opposite end of the strap, adjacent hole 67 if required, which can be particularly beneficial if the spacing between the holes towards one end of the strap is different to the spacing of the holes at the opposite end of the strap to accommodate a range of active lengths of the tie or strap between the two studs 68. FIG. 12 shows the same spanner 6 strapped to a smaller nut 5 by the tie or strap 66, using the hole 68 instead of hole 69 to shorten the active length of the tie or strap.

Figure 13:
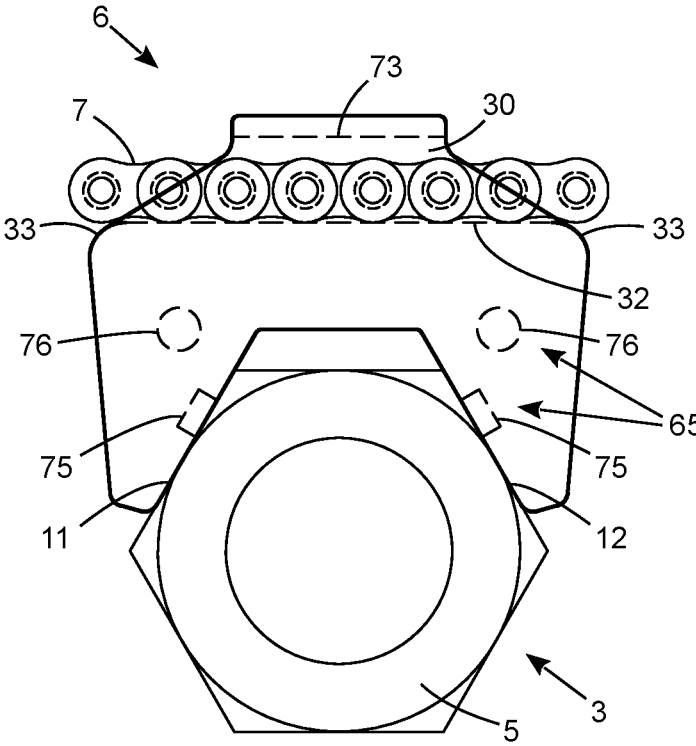
FIG. 13 shows a spanner including retaining magnets and an alternative shape of channel according to an embodiment of the present invention.
Figure 14:
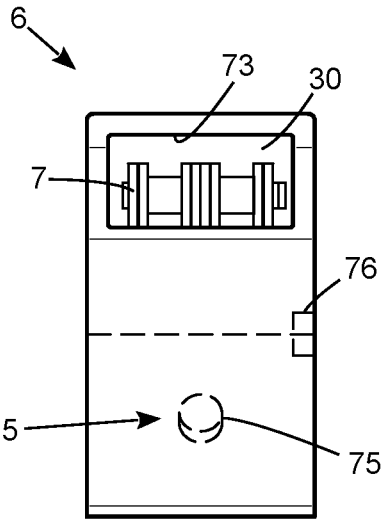
FIG. 14 is a projection from FIG. 13, with the fastener omitted for clarity.
Figure 15:
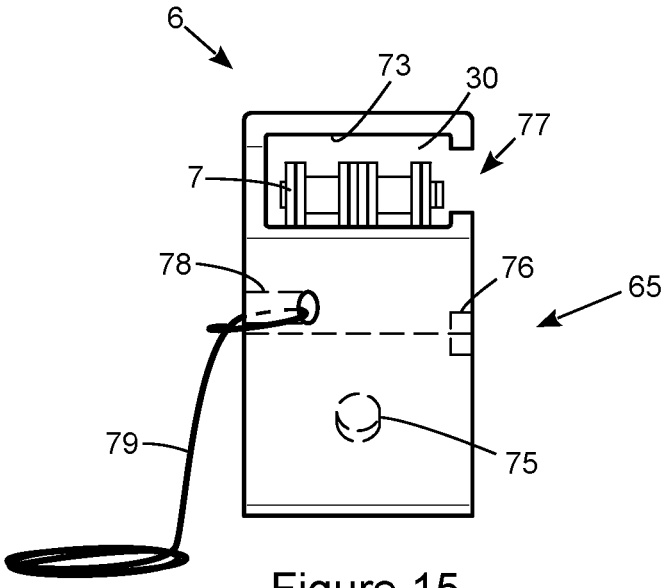
FIG. 15 shows a spanner including an alternative shape of channel and a leash according to an embodiment of the present invention.

FIGS. 13 to 23 show alternative forms of retaining arrangement 65, with the retaining arrangement being magnets 75, 76 in the examples in FIGS. 13 to 15. The magnets 75 are located in the first and second engaging surfaces 11, 12 although one or more magnets can be provided in only one of the engaging surfaces if preferred. These magnets can be useful where the fastener nuts 5 or bolt heads are attracted to magnets, for example if they are made from a ferromagnetic material. However, not all fasteners 3 are made from materials that are attracted to magnets, so additionally or alternatively one or more magnets 76 are located in the face of the spanner that can be placed adjacent the flange (not shown). This is useful when, for example, the flange is made from a material that is attracted to magnets.

In FIG. 13 the base surface 32 of the channel 30 extends for the majority of the width of the spanner 6, cut short only by the radius on each shoulder 33 at the ends of the surface. This provides beneficial geometry of the points on the spanner 6 where the chain 7 loads the body of the spanner to react torque from the fastener. However the material forming the remainder of the channel 30 above the base surface 32 is tapered down to the short top surface 73 in the front view of FIG. 13 since the additional material of a channel running the full width of the spanner can be ineffective, unless the height of the channel is close to the height of the chain links. However making the channel height close to the height of the chain links can make it difficult to load the chain through the spanner. Also removing material to form the tapered top section of the channel as shown can make the process of loading the chain through the spanner easier, particularly when the channel is closed as shown in the projection of the spanner of FIG. 13 shown in FIG. 14 without the fastener 3. FIG. 15 shows a similar view of a spanner to FIG. 14, but with one side of the channel open at gap 77. The gap 77 can be on either side of the spanner 6, for example on the same side as the spanner retaining magnet 76 as shown, or conversely on the opposite side to the spanner retaining magnet 76.

Also shown in FIG. 15 is a leash point in the form of a through-hole 78. A leash 79 is attached to the spanner 6 at the leash point, in this example through-hole 78. The leash can be used to tether the spanner to prevent it falling from the region of the flanged joint, which is beneficial for safety and time-saving should the spanner be dropped for example.

Figure 16:
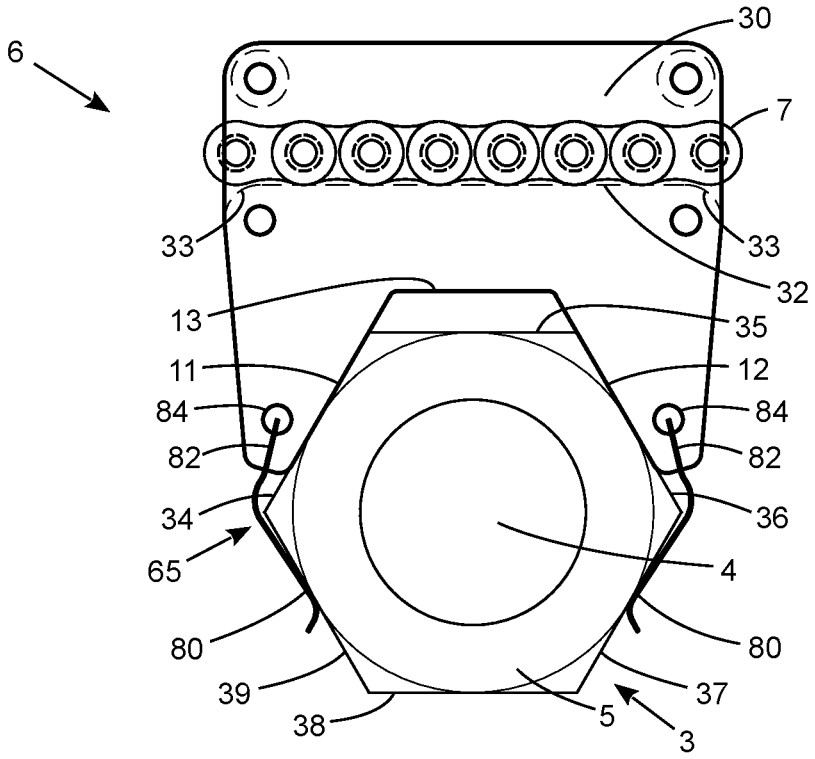
FIG. 16 shows a spanner including retaining spring clips according to an embodiment of the present invention.
Figure 17:
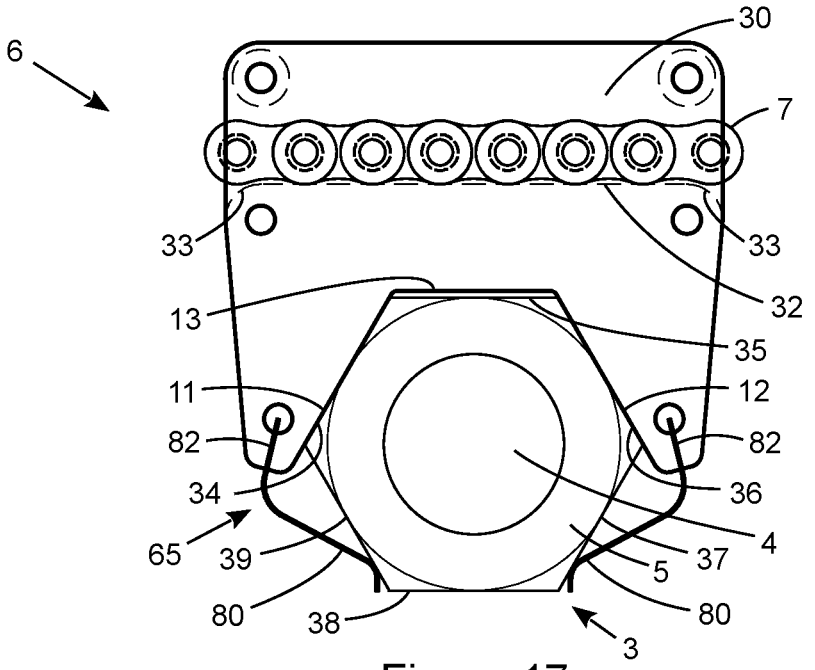
FIG. 17 shows the spanner from FIG. 16 on a smaller fastener.

FIGS. 16 and 17 show a retaining arrangement 65 comprising spring clips 80 to bias the nut 5 or bolt head of the fastener 3 into the engaging surfaces 11 and 13 in the spanner. Each spring clip 80 is held in a respective slot 82 in the body of the spanner 6. Holes 84 at the ends of the slots are provided to prevent stress raisers at the inner ends of the slots 82. As with FIGS. 11 and 12, FIG. 16 shows the spanner on a larger nut than FIG. 17, with the retaining arrangement pulling the faces 34 and 36 of the nut 5 into the engaging surfaces 11 and 12 of the spanner in all cases.

Figure 18:
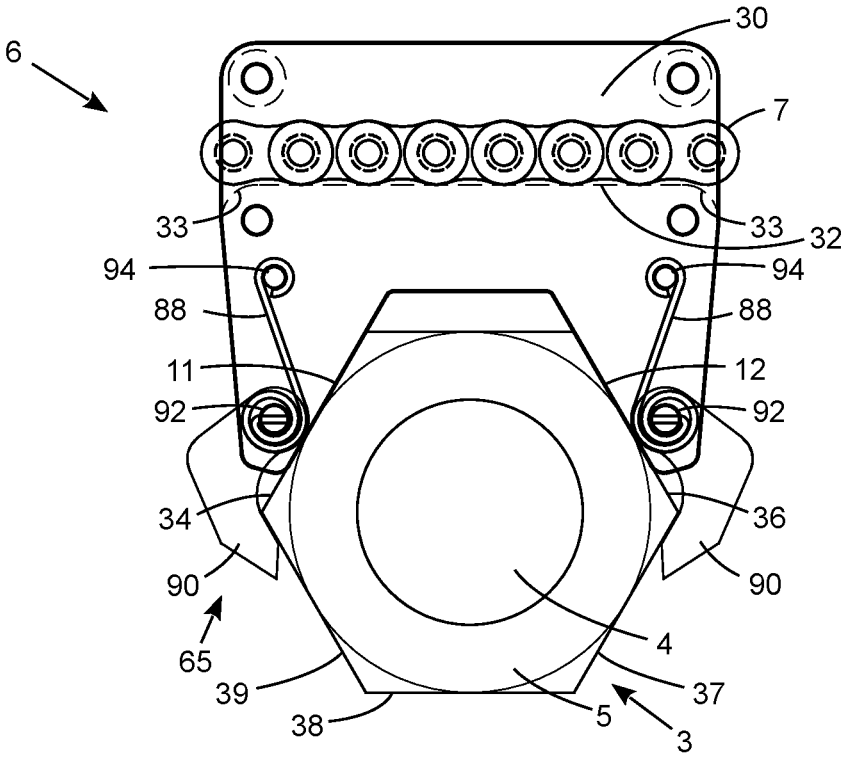
FIG. 18 shows a spanner including retaining sprung claws according to an embodiment of the present invention.
Figure 19:
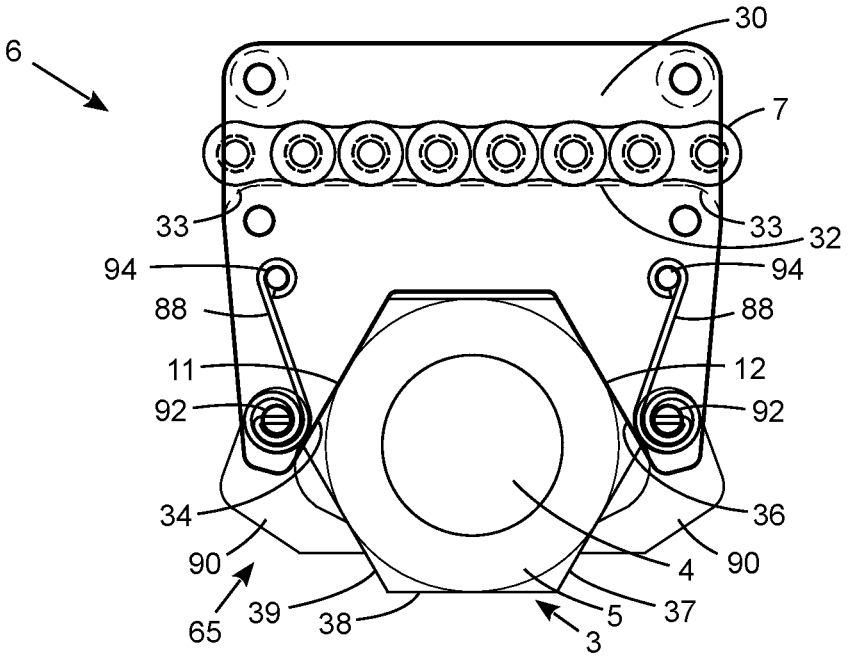
FIG. 19 shows the spanner from FIG. 18 on a smaller fastener.

FIGS. 18 and 19 show a retaining arrangement 65 comprising sprung claws 90 which pivot relative to the body of the spanner 6 at pins 92. The pins 92 are pressed into the claws 90 and slots or holes in the pins are used to fix one end of respective wire springs 88. The wire springs are anchored to the spanner body by posts 94 and wound up to rotationally load the claws 90 against the fourth and sixth faces 37, 39 of the nut 5, pulling the first and third faces 34 and 36 of the nut into the engaging surfaces 11 and 12 of the spanner 6. Again FIGS. 18 and 19 show the retaining arrangement 65 retaining different sizes of fastener 3 or nut 5.

Figure 20:
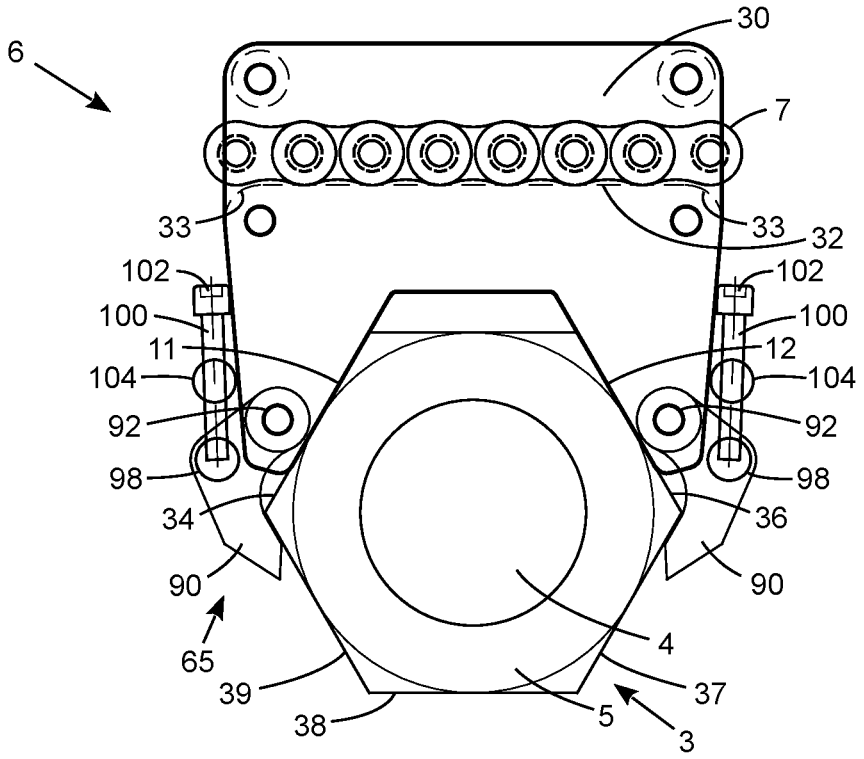
FIG. 20 shows a spanner including adjustable retaining claws according to an embodiment of the present invention.
Figure 21:
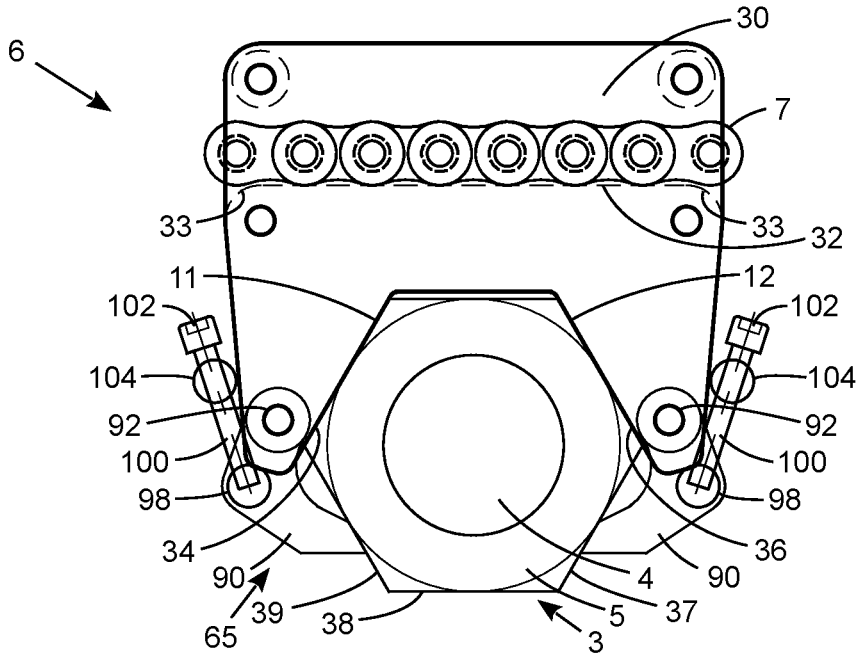
FIG. 21 shows the spanner from FIG. 20 on a smaller fastener.

FIGS. 20 and 21 show a retaining arrangement 65 comprising adjustable claws 90 which again pivot relative to the body of the spanner 6 at pins 92. However the rotational position of each claw 90 is controlled by a screw adjustment mechanism comprising an adjuster bolt 100 axially located in the claw by an adjuster bolt end retainer pivot enabling the bolt to rotate, relative to the claw, about its own axis and about an axis parallel with the pivot pin 92. A threaded pivot block 104 is pivotally connected to the body of the spanner 6, with the adjuster bolt 100 threaded through the block 104. Rotating the adjuster bolt 100 thereby adjusts the position of the respective claw 90. The adjuster bolt 100 can be rotated by driving the cap or head 102 of the bolt by hand using fingers or an Allen key for example, or by power tool such as an electric screwdriver with an appropriate bit. As shown in FIGS. 20 and 21, different size fasteners 3 or nuts 5 can be accommodated. If the adjuster bolts 100 are replaced by pins, if the threaded pivot blocks 104 are replaced with slider pivot blocks and if springs are added, the retaining arrangement 65 in FIGS. 20 and 21 can be transformed from a screw adjustable retaining claw arrangement into a resilient retaining claw arrangement.

Figure 22:
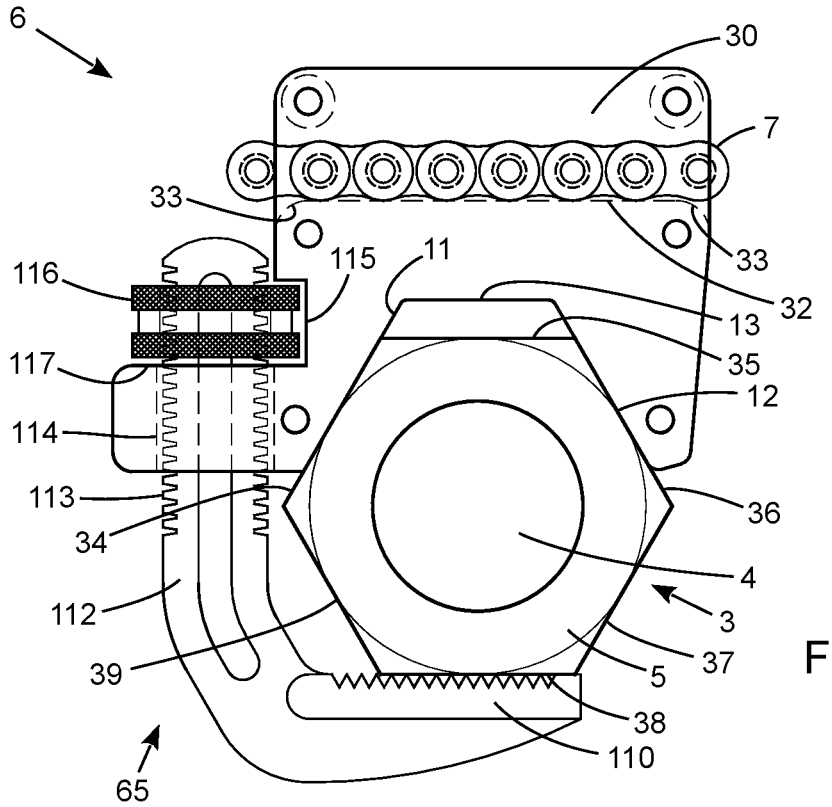
FIG. 22 shows a spanner including an adjustable retaining jaw according to an embodiment of the present invention.
Figure 23:
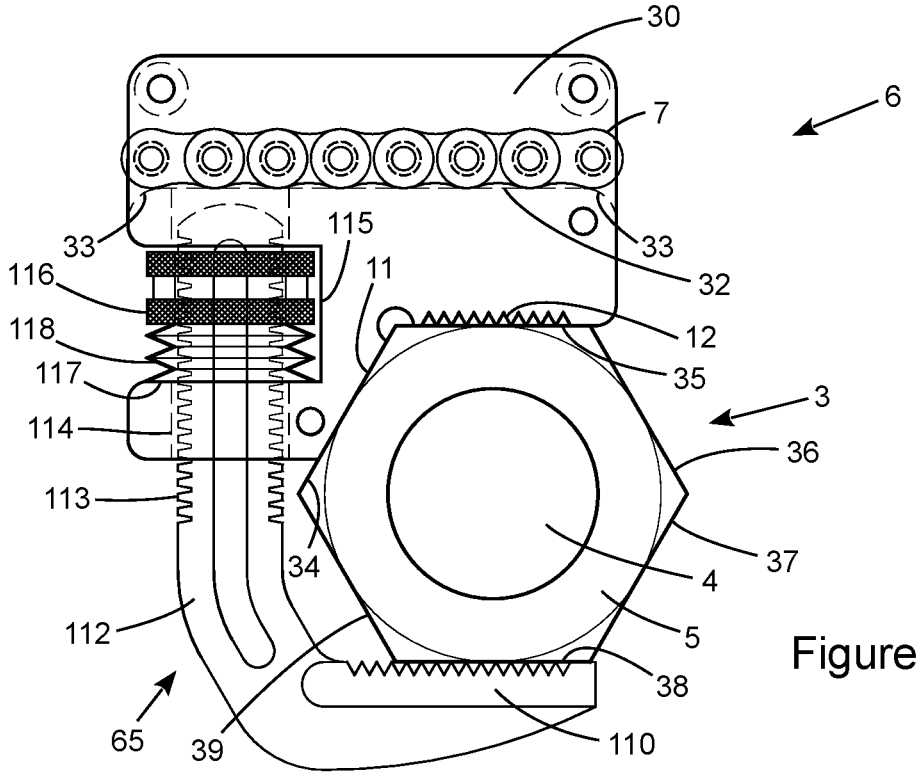
FIG. 23 shows an alternative spanner including a resiliently loaded retaining jaw according to an embodiment of the present invention.

FIGS. 22 and 23 show two alternative adjustable spanner type retaining arrangements 65 comprising a moveable jaw 110 on an L-shaped arm 112. In each case, the L-shaped arm 112 includes a toothed or threaded portion 113 which passes through a hole 114 in the spanner 6. A knurled nut 116 is threaded onto the L-shaped arm 112 and held axially relative to the body of the spanner 6 by recess 115. In FIG. 22, the adjustable or moveable jaw 110 of the retaining arrangement 62 can engage the fifth face 38 of the nut 5 and pull the engaging surfaces 11, 12 on the spanner 6 onto the first and third faces 34 and 36 of the nut 5. In FIG. 23 the engaging surfaces 11, 12 of the spanner 6 are adjacent, i.e. engaging the first and second faces 34, 35 of the nut 5. The moveable or adjustable jaw 110 engages the fifth face 38 of the nut 5. The screw adjustable retaining jaws 110 of FIGS. 22 and 23 can incorporate resilience such as the spring 118, formed for example by a stack of Belleville washers as shown in FIG. 23, transforming the screw adjustable retaining jaws of FIG. 22 into resiliently loaded retaining jaws. The resilience can include one or more resilient means (such as a coil spring, wave spring, or one or more Belleville washers as shown), provided between the knurled nut 116 and the tension face 117 of the recess 115.

The resilient types of retaining arrangement, i.e. the straps or ties 66 of FIGS. 11 and 12 if they are resilient, the spring clips of FIGS. 16 and 17 or the sprung claws of FIGS. 18 and 19 can be arranged to permit the spanner to move radially and the nut to slip rotationally within the spanner if the applied reaction torque exceeds a desired magnitude as determined by the tension in the flexible tension element (such as chain 7). Alternatively, the resilient types of retaining arrangement can be designed to enable the fastener or nut to rotate relative to the spanner if a predetermined maximum reaction torque limit is exceeded, i.e. the resilient retaining arrangement determines the reaction torque at which the spanner can move radially relative to the fastener or nut and in these cases the tension in the flexible tension element does not set the maximum reaction torque limit but must still allow sufficient radial motion of the loaded spanner in a backup wrench arrangement. The retaining arrangements of FIGS. 11, 12 and 16 to 23 can all include resilience to enable the maximum applied reaction torque limitation proposed by setting a known tension in the retaining arrangement and/or in the flexible tension element.

Figure 24:
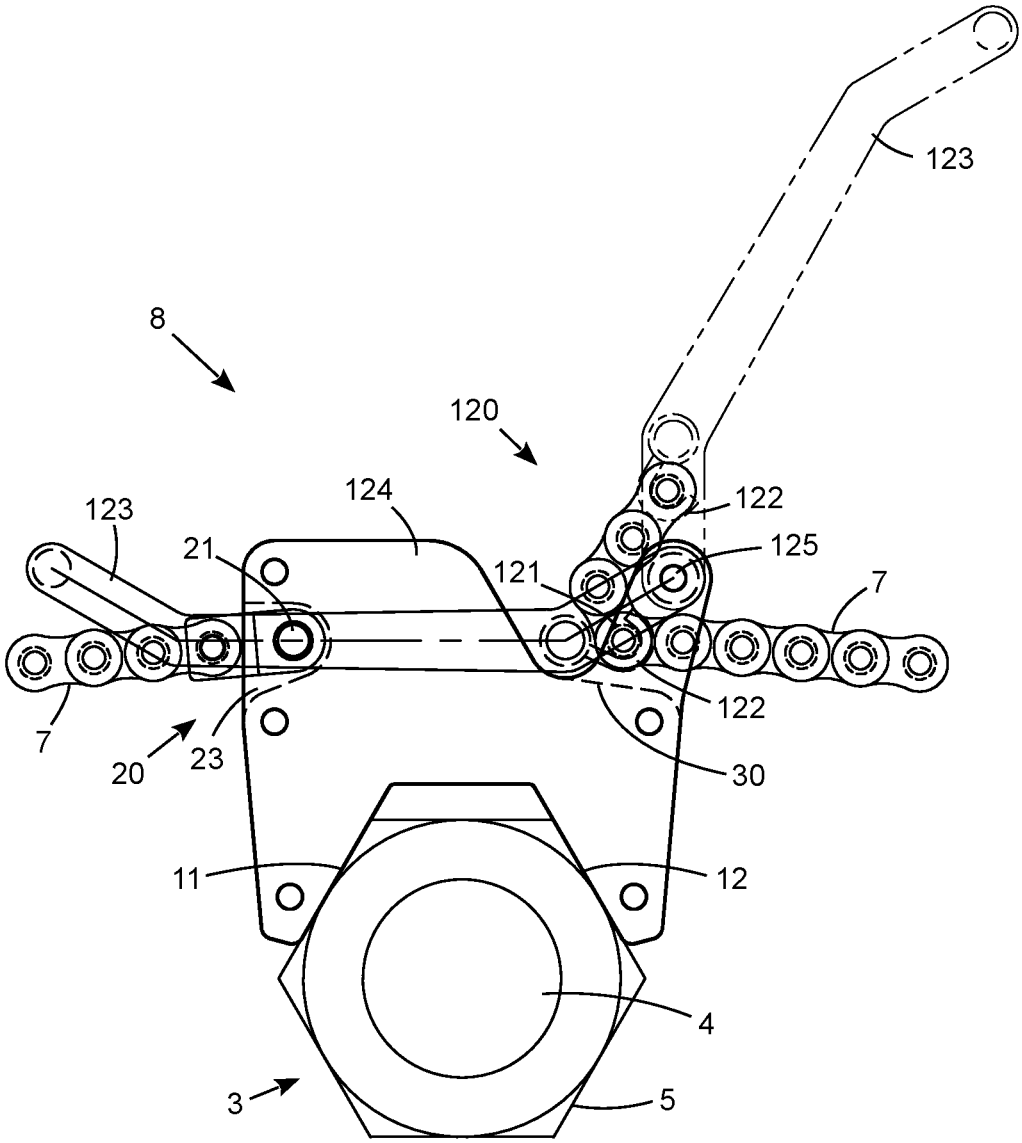
FIG. 24 shows a further alternative terminating spanner according to an embodiment of the present invention.

FIG. 24 shows a further alternative arrangement of the terminating spanner 8 using the same termination point 21 for the chain 7 as in FIGS. 2 and 9, but having a lever-operated tensioning arrangement 120. The chain 7 is passed through the channel 30 and a cylindrical portion 121 of the chain is placed on the hook 122. The tension in the chain can then be increased by rotating the lever 123 (as shown by the phantom line lever and hook) which displaces the hook and draws the chain through the channel, the lever being pivotally connected to the spanner body 124 by pin 125.

Figure 25:
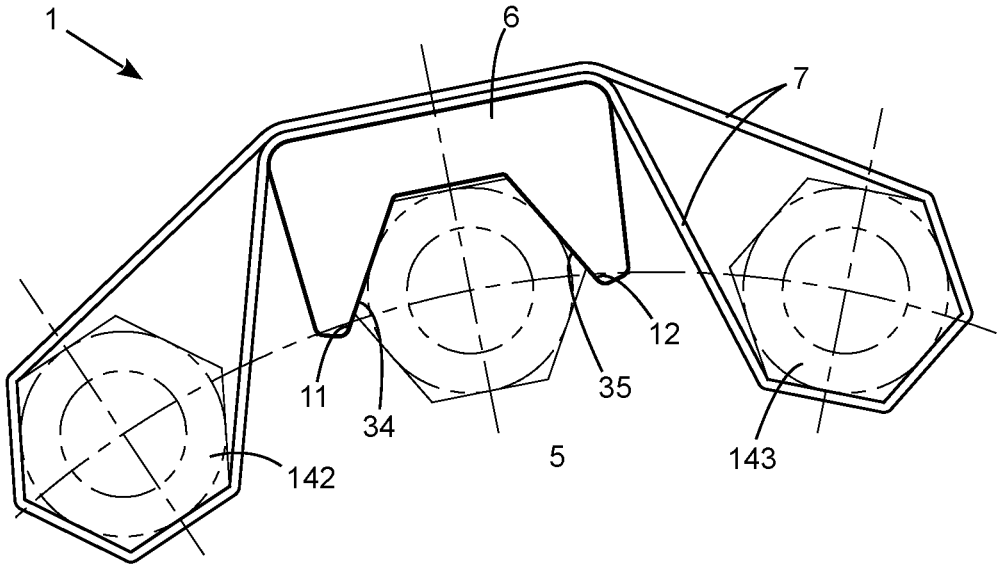
FIG. 25 is an end view of a backup wrench arrangement according to an embodiment of the present invention, in use.

FIG. 25 shows an alternate backup wrench arrangement 1 comprising a single spanner 6 which may for example be similar to any of the spanners in FIGS. 3, 5 to 8 or 11 to 21. However in the earlier Figures, the engaging surfaces 11 and 12 of the spanner 6 were biased onto or towards the first and second faces 34, 35 of the nut 5 by a chain or flexible tension element 7 that encompasses a circular array of nuts or bolt heads. Conversely in FIG. 25, the first and second engaging surfaces 11 and 12 of the spanner 6 are biased onto or towards the first and second faces 34, 35 of the first nut 5 by a flexible tension element 7 that is hooked onto or around the adjacent nut on either side of the first nut 5, i.e. the flexible tension element 7 can for example be a strap wrapped around second nut 142 and third nut 143 as shown. The flexible tension element 7 can be tensioned by any known means, so could for example be a ratchet strap. Multiple spanners 6 can be used, for example 3 spanners could be used, one on each of nuts 142, 5 and 143, with the flexible tension element wrapping around nuts at either end of the three nuts with spanners.

Figure 26:
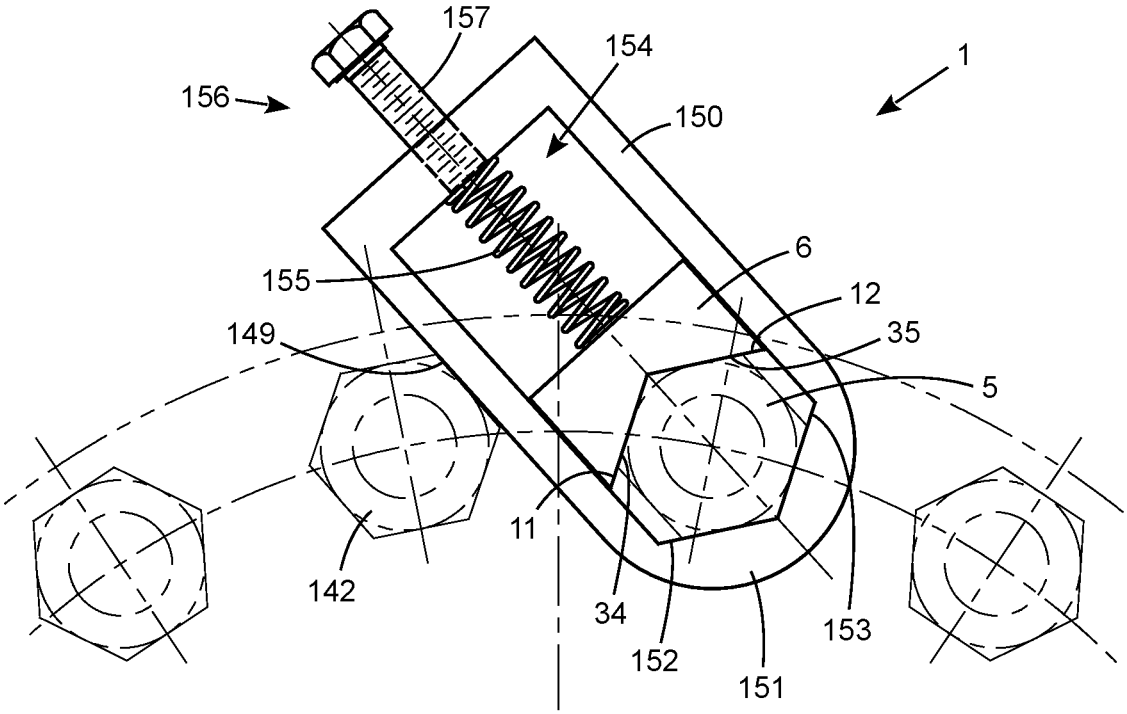
FIG. 26 is an end view of a backup wrench arrangement according to an embodiment of the present invention, in use.

FIG. 26 shows a further alternate backup wrench arrangement 1 comprising a single spanner 6 which has first and second engaging surfaces 11 and 12 engaged with the first and second faces 34 and 35 of the nut 5. The spanner 6 is located inside or relative to a lever portion 150 which in use contacts the second nut 142 and contact region 149 to react torque on the first nut 5. The lever portion 150 includes a first loop portion 151 around the nut 5. In this example the first loop portion includes first and second engagement surfaces 152, 153 of the loop 151 of lever portion 150 which can engage with faces on the nut 5. The first and second engaging surfaces 11 and 12 of the spanner are biased into contact with the first and second faces 34 and 35 of the nut 5 by a biasing arrangement 154 including a resilient member 155. The load on the resilient member 155 can be adjusted using a bias force adjuster 156 such as provided by the preload screw 157 thereby permitting adjustment of the biasing force applied to the spanner 6 towards the nut 5. The bias force adjuster 156 can include a micrometer type indication of the preload or biasing force, having for example different sets of graduations for different across-flats nut sizes.

While the inside of the loop 151 can be a curved surface contacting only the points of the fastener or nut 5, it can be preferable to provide flat surfaces such as the first and second engagement surfaces 152, 153 shown, to engage the flat surfaces of the nut 5, as this requires a radial displacement of the lever portion 150 in addition to the radial displacement of the spanner 6 in the opposite direction, providing greater spring displacement.

Figure 27:
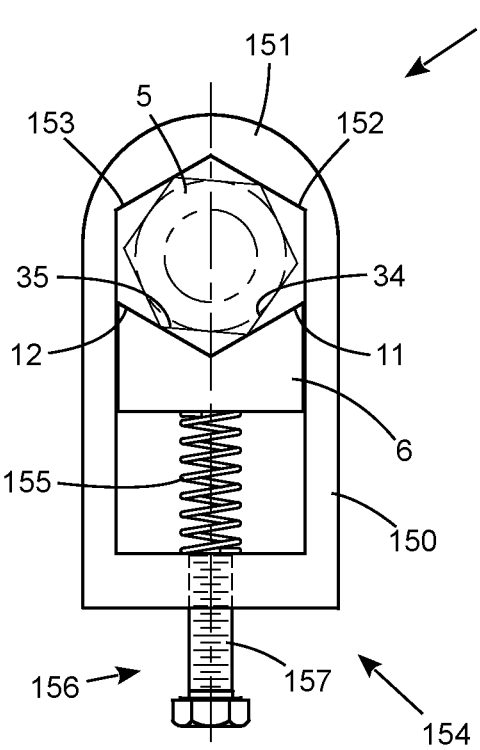
FIG. 27 shows the backup wrench of FIG. 26 with the spanner displaced.
Figure 28:
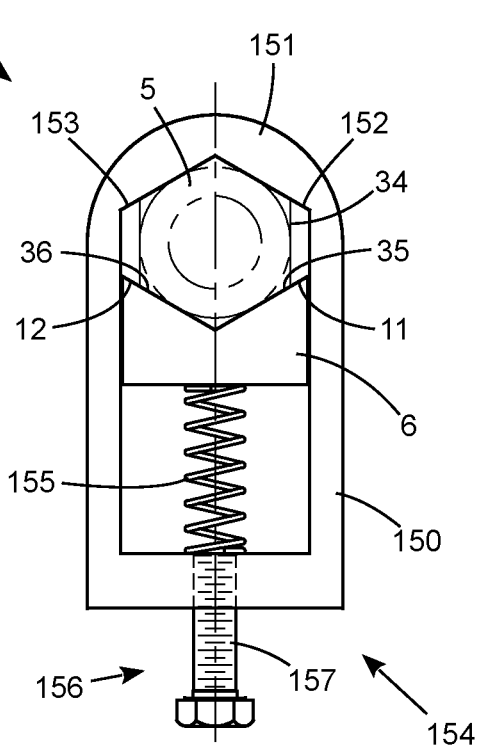
FIG. 28 shows the backup wrench of FIG. 26 with the spanner engaged with the nut.

FIG. 27 shows the torque limiting operation of the backup wrench arrangement. As the reaction torque applied to the first nut 5 generates a force on the spanner exceeds the biasing force, the spanner 6 slides radially away from the nut 5 and the nut can then rotate. As shown in FIG. 28, the backup wrench arrangement 1 can rotate away from the second nut (not shown) or the nut 5 can be rotated relative to the backup wrench arrangement 1 until the first and second engaging surfaces 11 and 12 are again in contact with two faces of the nut 5, now the second and third faces 35 and 36.

Figure 29:
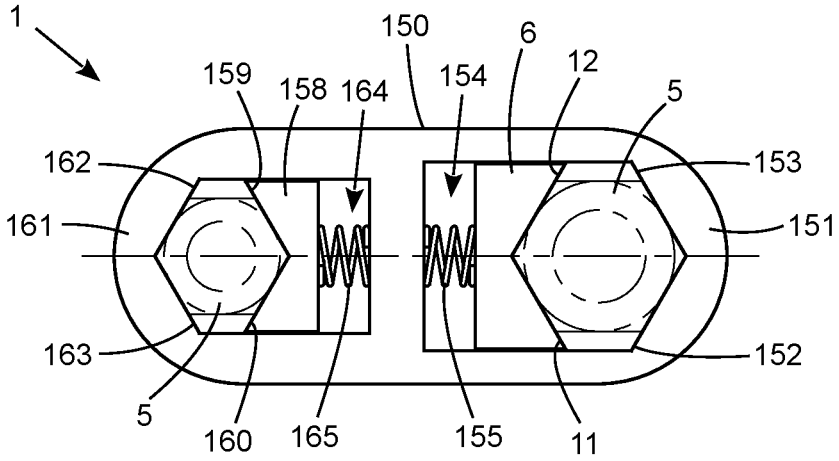
FIG. 29 shows a double-ended backup wrench according to an embodiment of the present invention, similar to the single-ended backup wrench of FIGS. 26 to 28.

While the backup wrench arrangement 1 of FIGS. 26 to 28 can accommodate a range of across flat nut sizes, the range can be further increased by providing a similar biased spanner at each end of the wrench 1. So in FIG. 29 in addition to the first spanner 6 and first biasing arrangement 154, there is also provided at the opposite end of the lever portion 150 a second spanner 158 and a second loop portion 161. The second spanner is shown with first and second engaging surfaces 159 and 160 and the second loop portion 161 is shown with first and second engagement surfaces 162, 163 between which a smaller nut can be gripped. A single, common biasing arrangement can be used between the first and second spanners 6 and 158, however it is preferable to provide individual biasing arrangements. Hence a second biasing arrangement 164 is shown including a second resilient member 165.

While FIG. 24 shows a quick-release type arrangement for application and release of tension in the flexible tension element, the quick-release function can be desirable in the other arrangements. For example, the tension in the flexible tension element in FIG. 25 can be set with a bias force adjuster such as a screw adjustment, then released and re-applied using a lever arrangement. Similarly the compression of the spring in FIG. 26 can be adjusted as discussed using a screw type bias adjuster and released or re-applied using an over-centre lever arrangement type of quick-release. Where the backup wrench arrangement comprises a single active spanner as in FIGS. 25 to 29, so reacts torque on only one fastener at a time and needs to be moved around a flange where multiple fasteners are provided, it is particularly beneficial to incorporate a quick-release arrangement to facilitate faster application and removal of the backup wrench arrangement from fastener to fastener. The ability to reduce or release the load in the biasing arrangement allows the residual reaction torque to be realised from a wrench that can otherwise remain jammed against the adjacent nut or other feature used to assist with provision for the reaction torque, which in turn allows for safer removal of the backup wrench after a tightening operation. The quick-release for removing and re-applying or for reducing and restoring the biasing force can be combined with the bias force adjuster or provided separately.

Figures 30, 31:
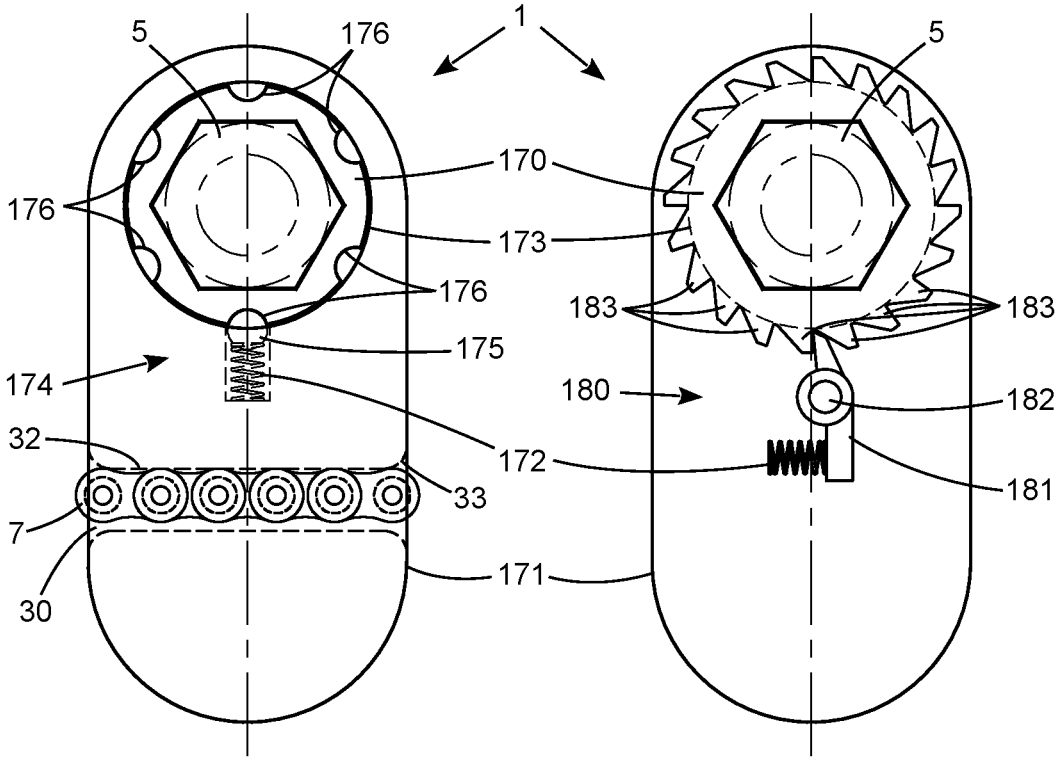
FIG. 30 is an end view of a backup wrench arrangement according to an embodiment of the present invention, incorporating a detent.
FIG. 31 is an end view of a backup wrench arrangement according to an embodiment of the present invention, incorporating a load sensitive pawl.

FIG. 30 shows an alternative backup wrench arrangement 1 in which a socket portion 170 is located at least partially within a substantially circular hole 173 in lever portion 171. The substantially circular hole 173 can be a recess or a cavity. The socket portion 170 is able to rotate relative to the lever portion 171, although any such relative rotation must overcome the limit torque provided by detent mechanism 174. The socket portion can provide a 6 point or 12 point opening as is typical for conventional sockets and the ends of conventional box-end wrenches or ring spanners for use with hexagonal nuts and bolt heads. In use, the socket portion is for example placed on a nut 5 and the lever portion is rotated or can rotate until in contact with a second nut (not shown) to react a torque on the nut 5. Once the reaction torque on the nut exceeds a pre-set magnitude or threshold, the detent ball 175 is pushed out of the detent socket 176 against the resilient member 172. The backup wrench arrangement can therefore provide a reaction torque up to a limit that is determined by a number of factors such as the shape of the detent sockets 176, size of the detent ball 175, force-deflection characteristic (e.g. preload and/or stiffness) of the resilient member 172.

The backup wrench arrangement in FIG. 31 uses a ratchet like mechanism 180, except that it incorporates the resilient member 172 to permit rotation of the socket portion 170 relative to the lever portion 171 once a limit reaction torque on nut 5 is exceeded, rather than simply prevent rotation in that direction as a conventional ratchet would. Again, in use, the lever portion would contact another object such as a second nut (not shown). Teeth 183 are provided on the socket portion 170 and pawl 181 engages with the teeth and is pivotally connected to the lever portion 171 at pivot 182. Rotation of the socket portion 170 due to reaction torque with the nut 5 is resisted by the pawl 181 until the moment on the pawl generated by the teeth on the socket exceeds the moment on the pawl due to the resilient member 172, at which point the pawl rotates clockwise again the resilient member and the socket portion 170 can rotate relative to the lever portion 171.

Although the backup wrench arrangements of FIGS. 26 to 28 and 30 to 31 show a lever portion 150 or 171 to react the reaction torque against an adjacent body or feature such as the second nut 142 in FIG. 26, a flexible tension element such as the chain 7 shown in FIGS. 3, 5 to 8 and 13 to 15 for example passing through a channel 30 can be used in generating the reaction torque. There are multiple advantages to using a flexible tension element in a channel rather than a lever portion reacting against an adjacent nut, the main ones being: the ability to apply a single tension to the flexible tension element to prepare it for generating the reaction torques from each of the respective nuts; and the ability to release the mechanism to enable the wrenches to be unloaded and removed with ease.

So FIG. 30 also shows a channel 30 through the lever portion 171, with a chain or similar flexible tension element 7 passing through the channel adjacent the base 32 of the channel. The reaction torque is primarily resolved by the chain or flexible tension element 7 at the shoulder 33 at the end of the channel 30. The tension on the flexible tension element can be provided as discussed with relation to FIGS. 1 to 24. For example where multiple back wrench arrangements, such as that in FIG. 30, are used as individual spanners for individual nuts in an array such as on a flanged pressure joint, reacting against a flexible tension element 7, the lever portion 171 of one of the backup wrench arrangements can include a tensioning arrangement such as shown in the terminating spanners in FIG. 2, 9, 10 or 24.

Each of the arrangements in FIGS. 1 to 31, the spanner 6 or socket 170 can permit rotation of the first nut 5 when the reaction torque from the nut exceeds a pre-set or threshold amount. This provides a continuous rotation torque release function where, if continued tightening torque is applied to the fastener, the nut can rotate, unlike the torque indication type mechanisms of most types of torque wrenches, so the performance of the torque limiting function is not dependent on an operator recognising (hearing or seeing) a torque limit indication. Therefore the present invention can provide a true torque limiting function.

Figure 32:
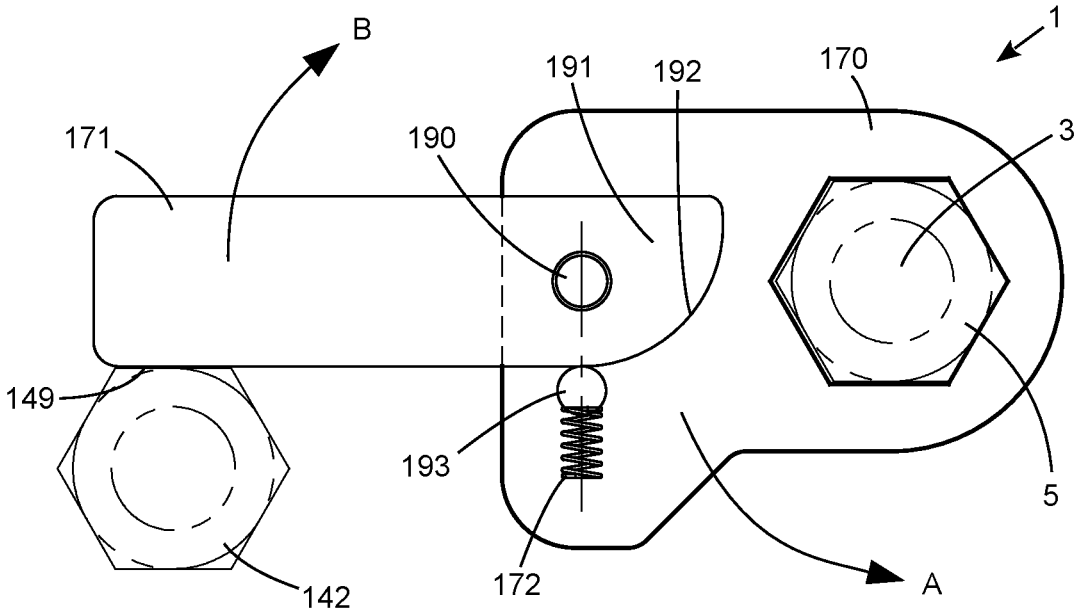
FIG. 32 is an end view of a backup wrench arrangement according to an embodiment of the present invention, incorporating a rotating lever portion.

FIG. 32 shows another alternate backup wrench arrangement 1 comprising a socket portion 170 on a first nut 5 on a first fastener 3 that is being tightened, and a lever portion 171 reacting a portion of the tightening torque on nut 5 (i.e. not the face friction torque) against a second nut 142 at a contact region 149. In this example, the lever portion 171 is pivoted relative to the socket portion 170 at pivot 190. The first end 191 of the lever portion 171 includes a cam-shaped surface 192 to ensure that the lever portion has a desired neutral position. A ball or roller 193 is biased onto the cam-shaped surface 192 by the resilient member 172. As the torque from the first nut 5 to the socket 170 increases with tightening of the first fastener 3, the socket portion rotates in the direction indicated by arrow A, the resilient member is compressed and the lever portion 171 rotates in the direction indicated by arrow B. The limit torque resisted by the backup wrench arrangement 1 is determined at least in part by the geometry of the resilient member 172, pivot location 190 and position of second nut 142, beyond which the lever portion 171 may pass between first nut 5 and second nut 142.

In order to provide the continuous rotation torque release function of the other Figures, the lever portion 171 and the main body including the socket portion 170 need to be made small enough to clear a pipe to which the bolted flange is connected whilst still engaging with the second nut 142. While this may be possible in some applications it is not possible in all applications, limiting the applicability of this particular embodiment shown in FIG. 32.

In FIGS. 26 to 32 the resilient member 155 or 172 is shown as a coil spring, but may be any resilient member such as a compressible block or a flexing shaft or beam for example. A bias force adjuster 156 acting on the resilient member 155 in FIGS. 26 to 28 can similarly be provided for the resilient member 172 in FIGS. 30 to 32 to enable adjustment of the limit reaction torque on nut 5 that is resisted by the backup wrench arrangement 1.

Although hexagonal nuts and bolt heads are shown in the above examples, the fastener nuts or bolt heads can be other shapes, such as square, or any other polygonal nut or bolt head. For hexagonal nuts and bolt heads, the spanner 6 can have the two engaging surfaces 11 and 12 adjacent as in FIGS. 8 and 26 for example, of have the two engaging surfaces 11 and 12 separated by an internal surface 13 as shown for example in FIGS. 3 and 5.

Any of the engaging surfaces such as 12 in FIG. 23 can include at least one ridge or groove to improve grip of the nut 5. In FIG. 23 the engaging surface 12 is shown as a serrated finish, i.e. having multiple grooves but any number of grooves including one groove on at least one engaging surface is envisaged, as are other methods of improving the grip of the engaging surfaces to the faces of the nut. For example at least a portion of one of the engaging surfaces 11 and/or 12 may be roughened for example by knurling.

The backup wrench arrangement is shown on circular arrangements of bolts in FIGS. 1 and 4, but can be used on other layouts of bolts. It can also be used on a wide range of bolt spacings. For example the backup wrench arrangement inherently adapts to different diameters of rings of bolts and different pitch spacing between the bolts.

The flexible tension element can be a strap or wire rope for example in place of the chain 7. None of the spanners need to include a tensioning arrangement, since the tensioning arrangement can be provided either separately, or as part of the flexible tension element. For example, a ratchet strap can be used, in which case the flexible tension element can be a webbing strap and the tensioning arrangement is fixed to one end of the strap and in use has the other end of the strap passed into the tensioning arrangement and tightened.

The invention claimed is:

1. A backup wrench arrangement comprising:

a first fastener engager comprising a first engagement surface and a second engagement surface, each of the first and second engagement surfaces configured to engage with a respective face of a first nut or bolt head on a first fastener when in use, a reaction torque releasing arrangement for selectively reducing or releasing a reaction torque to enable the backup wrench arrangement to be removed, wherein the first fastener engager is configured to automatically allow rotation of the first nut or bolt head of the first fastener relative to the backup wrench arrangement when the first nut or bolt head of the first fastener is subjected to a reaction torque above a threshold reaction torque, wherein the rotation of the first nut or bolt head is allowed by a motion of the first fastener engager determined by a magnitude of the reaction torque and a force-deflection characteristic of a biasing arrangement acting directly or indirectly on the first fastener engager to automatically allow continuous rotation while the reaction torque is greater than the threshold reaction torque.

2. The backup wrench arrangement of claim 1, wherein the reaction torque arrangement is provided by making a load in the biasing arrangement selectively reducible or releasable.

3. The backup wrench arrangement of claim 1, wherein the threshold reaction torque is between 5 percent and 50 percent of a target tightening torque to be applied to the first fastener.

4. The backup wrench arrangement of claim 1, wherein the motion of the first fastener engager is substantially radial, wherein the biasing arrangement is configured to provide a biasing force to bias the first and second engagement surfaces of the first fastener engager onto the respective faces of the first nut or bolt head of the first fastener.

5. The backup wrench arrangement of claim 4, wherein the biasing arrangement comprises a flexible tension element, wherein the biasing arrangement is configured to act directly or indirectly on at least a second nut or bolt head to bias the first and second engagement surfaces of the first fastener engager towards the respective faces of the first nut or bolt head.

6. The backup wrench arrangement of claim 5, wherein the biasing arrangement is configured to act on the second nut or bolt head and on a third nut or bolt head.

7. The backup wrench arrangement of claim 5, wherein the backup wrench arrangement further comprises at least one second fastener engager, wherein the at least one second fastener engager further comprises a guide configured to partially locate the flexible tension element, wherein the at least one second fastener engager is configured to engage with a respective nut or bolt head when in use.

8. The backup wrench arrangement of claim 5, further comprising a tensioning arrangement configured to apply a tension to the flexible tension element when in use.

9. The backup wrench arrangement of claim 4, wherein the backup wrench arrangement comprises a lever portion having a first loop portion at a first end, wherein the first loop portion is arranged to pass around a portion of the first nut or bolt head when in use, wherein the first fastener engager is slidably located relative to the lever portion, wherein the biasing arrangement is configured to act between the lever portion and the first fastener engager, and wherein the lever portion is configured to contact another nut to prevent rotation of the lever portion.

10. The backup wrench arrangement of claim 9, wherein the biasing arrangement comprises a resilient device, wherein a load on the resilient device is configured to be adjustable to adjust the biasing force, and wherein the reaction torque acting on the first nut or bolt head varies based on the adjustable load on the resilient device, and wherein the reaction torque acts on the first nut or bolt head up to the threshold reaction torque, wherein above the threshold reaction torque, the first fastener engager deflects the resilient device and permits rotation of the first nut or bolt head.

11. The backup wrench arrangement of claim 9, wherein the backup wrench arrangement comprises a lever portion and further comprises a second fastener engager, wherein the lever portion comprises a second loop portion at a second end arranged to pass around a portion of a second nut when in use, wherein the second fastener engager is configured to be slidably located relative to the lever portion, wherein the biasing arrangement is configured to act between the lever portion and the second fastener engager, wherein the lever portion is configured to contact another nut to prevent rotation of the lever portion.

12. The backup wrench arrangement of claim 4, wherein at least one of the first engagement surface and the second engagement surface comprises a ridge or groove.

13. The backup wrench arrangement of claim 4, wherein the backup wrench arrangement further comprises a quick-release arrangement configured to reduce and restore the biasing force.

14. The backup wrench arrangement of claim 1, wherein the backup wrench arrangement further comprises a lever portion, wherein the motion of the first fastener engager is configured to substantially rotate relative to the lever portion, wherein such relative rotation is configured to be inhibited by and/or require deflection of the biasing arrangement.

15. The backup wrench arrangement of claim 14, wherein the biasing arrangement comprises a resilient member, and wherein the first fastener engager comprises a socket portion.

16. The backup wrench arrangement of claim 15, wherein the lever portion comprises a substantially circular hole into which the socket portion protrudes or is housed, wherein the backup wrench further comprises a detent mechanism comprising the resilient member, wherein the detent mechanism is configured to act between the lever portion and the socket portion to prevent said relative motion until the threshold reaction torque on the first nut is exceeded.

17. The backup wrench arrangement of claim 15, wherein the lever portion comprises a substantially circular hole into which the socket portion protrudes or is housed, wherein the backup wrench further comprises a ratchet mechanism comprising teeth on the socket portion and a pawl pivotally mounted to the lever portion, wherein the resilient member is configured to act between the pawl and the lever portion, and wherein when the threshold reaction torque on the first nut is exceeded, one of the teeth on the socket is configured to provide a force generating a moment on the pawl that exceeds a moment applied to the pawl by the resilient member.

18. The backup wrench arrangement of claim 15, wherein the lever portion is attached to the socket portion by a pivot, wherein the resilient member is connected directly or indirectly between the socket portion and the lever portion such that the relative rotation between the socket portion and the lever portion generates a deflection of the resilient member, wherein the lever portion and resilient member is arranged such that when a reaction torque on the first nut generates a limit moment on the lever portion reacted by a second nut, the limit moment deflects the resilient member to permit sufficient relative rotation of the lever portion and the socket portion such that the lever portion passes between the first nut and the second nut.

19. The backup wrench arrangement of claim 1, wherein the first nut or bolt head is a first nut and wherein the first fastener further comprises a second nut or bolt head, wherein a tightening torque is applied to the first fastener at the second nut or bolt head when in use.

20. The backup wrench arrangement of claim 1, wherein the first nut or bolt head is a first bolt head, wherein the fastener comprises a second nut, wherein a tightening torque is applied to the first fastener at the second nut when in use.

21. The backup wrench arrangement of claim 1, wherein the first fastener engager further comprises a retaining arrangement.

22. The backup wrench arrangement of claim 1, wherein the first fastener engager is configured to retain nuts or bolt heads of differing sizes.

23. The backup wrench arrangement of claim 1, wherein the first fastener engager further comprises a leash point.

24. A fastener backup method, comprising:

placing at least one fastener engager of a backup wrench arrangement on a respective nut or bolt head of an arrangement of fasteners, wherein the backup wrench arrangement comprises the at least one fastener engager comprising a first engagement surface and a second engagement surface, each of the first and second engagement surfaces configured to engage with a respective face of the nut or bolt head on a fastener when in use, and a reaction torque releasing arrangement for selectively reducing or releasing a reaction torque to enable the backup wrench arrangement to be removed, wherein the at least one fastener engager is configured to automatically allow rotation of the nut or bolt head of the fastener relative to the backup wrench arrangement when the nut or bolt head of the fastener is subjected to a reaction torque above a threshold reaction torque, and wherein the rotation of the nut or bolt head is allowed by a motion of the fastener engager determined by a magnitude of the reaction torque and a force-deflection characteristic of a biasing arrangement acting directly or indirectly on the fastener engager to automatically allow continuous rotation while the reaction torque is greater than the threshold reaction torque;

disposing a flexible tension element in a channel of the fastener engager or each said fastener engager around the arrangement of fasteners; and applying a tension to the flexible tension element.

25. The fastener backup method of claim 24, wherein placing the at least one fastener engager of a backup wrench on a respective nut or bolt head of an arrangement of fasteners further comprises coupling the fastener engager to the respective nut or bolt head.

26. The fastener backup method of claim 25, wherein coupling the fastener engager to the respective nut or bolt head comprises at least one of:

engaging at least one respective magnetic portion of the fastener engager with the nut, bolt head or an adjacent surface; and engaging a respective tie from a respective fastener engager around the respective nut or bolt head and back to the fastener engager.

27. The fastener backup method of claim 24, wherein applying a tension to the flexible tension element comprises applying a known or measured tension to the flexible tension element.

28. The fastener backup method of claim 24, wherein the arrangement of fasteners is a ring of bolts clamping a pressure boundary bolted joint or a flanged connection.

* * * * *